US006702275B2

(12) United States Patent
Niiyama et al.

(10) Patent No.: US 6,702,275 B2
(45) Date of Patent: Mar. 9, 2004

(54) PAPER-LEAVES SEPARATING/SUPPLYING METHOD AND APPARATUS

(75) Inventors: Yuichi Niiyama, Kawasaki (JP); Akira Shimasaki, Yokohama (JP); Akihiko Nakamoto, Yokohama (JP); Nobuo Shibata, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 34 days.

(21) Appl. No.: 09/824,235

(22) Filed: Apr. 3, 2001

(65) Prior Publication Data

US 2001/0028142 A1 Oct. 11, 2001

(30) Foreign Application Priority Data

Apr. 3, 2000 (JP) ..... 2000-101626
Apr. 3, 2000 (JP) ..... 2000-101627
Apr. 3, 2000 (JP) ..... 2000-101638

(51) Int. Cl.[7] ..... B65H 3/14; B65H 1/02; B65H 3/46

(52) U.S. Cl. ..... 271/98; 271/31.1; 271/106

(58) Field of Search ..... 271/98, 106, 31.1

(56) References Cited

U.S. PATENT DOCUMENTS 4,451,028 A * 5/1984 Holmes et al. ..... 271/108
5,308,052 A * 5/1994 Roch et al. ..... 271/105
5,478,066 A * 12/1995 Yoshida et al. ..... 271/104
5,704,607 A * 1/1998 Brotherston ..... 271/104
5,722,652 A * 3/1998 Yoshida et al. ..... 271/10.03
5,988,626 A * 11/1999 La Vos et al. ..... 271/106
6,082,728 A * 7/2000 Ubayashi ..... 271/105
6,123,330 A * 9/2000 Schaal ..... 271/31
6,186,491 B1 * 2/2001 Tomiyama et al. ..... 271/10.03

* cited by examiner

*Primary Examiner*—Donald P. Walsh
*Assistant Examiner*—Jonathan R Miller
(74) *Attorney, Agent, or Firm*—McDermott, Will & Emery

(57) ABSTRACT

In a paper-leaves separating/supplying apparatus comprising a rotary separating/supplying belt, a vacuum suction device and a separating/supplying device, the vacuum suction device takes up one by one a plurality of paper leaves set together and conveyed as far as a position at which they come into contact with a belt surface of the separating/supplying belt so that the paper leaf is attached onto the belt surface and is fed toward the downstream side in accordance with the rotary motion of the separating/supplying belt. The belt surface of the separating/supplying belt is placed in a state perpendicular to a traveling plane of the paper leaves or in a state inclined toward the paper leaves. With this construction, when the paper leaves are fed successively, the preceding paper leaf coming previously into contact with the belt surface is attracted and held on the separating/supplying belt in a state parallel with or inclined toward the succeeding paper leaf so that the weight of the succeeding paper leaf hardly fall on the preceding paper leaf. This minimizes the contact pressure between the preceding paper leaf and the succeeding paper leaf, thus achieving smooth feeding of the paper leaves.

22 Claims, 30 Drawing Sheets

PAPER-LEAVES SEPARATING/SUPPLYING METHOD AND APPARATUS

BACKGROUND OF THE INVENTION

1) Field of the Invention

The present invention relates to a paper-leaves separating/supplying method and apparatus suitable for use in a paper-leaves division system and properly employable in separating a plurality of paper leaves such as mail, deposited together in a bundle, to convey them one by one to a partitioning section.

2) Description of the Related Art

In the recent years, a mail division apparatus, which includes a recognizing function for reading a bar-code attached to mail or a character recognizing function for reading destination information such as a postal code to divide the mail automatically on the basis of these destination information, has been put in practical use. Such a paper-leaves division apparatus, which is made to handle mail or the like (which will be referred to hereinafter to "paper leaves (sheets)"), has been required to meet requirements such as space-saving, labor-saving, cost reduction and fast operation (speed-up). A means to realize the fast operation of these requirements has been required to eliminate the occurrence of troubles such as overlap transportation in the middle of the conveyance and further to accomplish the conveyance and the partitioning operation promptly and accurately.

In general, such a type of paper-leaves division apparatus is designed to separate a plurality of paper leaves to be divided, deposited together in a bundle in a stand-up condition, from each other in a separating/supplying section and subsequently send them successively toward the downstream side. Accordingly, if the separating/supplying section cannot achieve the separation of the paper leaves properly and promptly, then this has great influence on the subsequent reading of the address information and the accuracy and speed of the partitioning operation. In addition, the proper and prompt separation in the separating/supplying section provides an effect to enhance the handling ability of a large number of paper leaves. Accordingly, for achieving the fast separation of the paper leaves, a simple-structure paper-leaves arrival detecting means is provided at a paper-leaves feeding (transferring) position to detect the arrival of the paper leaves.

Meanwhile, the fast and continuous conveyance of a large quantity of paper leaves may cause slight operational discordance in the paper-leaves conveyance path to develop instability factors so that the interval between one paper leaf and the subsequent another paper leaf lengthens and shortens, thus leading to the occurrence of overlap transportation so that difficulty is experienced in correctly conducting the partitioning operation of the paper leaves to be done after the conveyance. One of the instability factors is that, in a case in which paper leaves are fed in a collectively set condition and in a stand-up condition, if a paper leaf (which will be referred to hereinafter as a "succeeding paper leaf") traveling afterward falls down to lean against a paper leaf (which will be referred to hereinafter as a "preceding paper leaf") running ahead of the succeeding paper leaf, the weight of the succeeding paper leaf is placed on the preceding paper leaf, thus generating a contact pressure between the preceding paper leaf and the succeeding paper leaf. In addition, this contact pressure develops a load at the feed of the preceding paper leaf to hinder the smooth feeding operation, or the succeeding paper leaf is dragged by the preceding paper leaf to fall into an irregular condition so that the further feeding of the succeeding paper leaf can be conducted in an unstable state. Still additionally, the sucking paper leaf is dragged by the preceding paper leaf to be sent in a state where two pieces overlap with each other, that is, the so-called overlap transportation occurs. Accordingly, in order to solve these problems, there is a need to reduce the contact pressure between the preceding paper leaf and the succeeding paper leaf by as much as possible in feeding (letting out) the preceding paper leaf.

Furthermore, a key to fast and continuous conveyance of a large quantity of paper leaves is that the system accurately recognizes the arrival of paper leaves at a separating/feeding belt surface and appropriately feeds the paper leaves successively or continuously. A conventional mechanical paper-leaves arrival detecting means is placed immediately before the separation/supply section and is designed to make a decision on the arrival in a manner that a paper leaf is brought into point (or line) contact with the paper-leaves arrival detecting means. In addition, this paper-leaves arrival detecting means can fail to detect the arrival of the paper leaves depending upon situations such as the weight, thickness, surface roughness or supplying posture of the paper leaves, which interferes with the prompt separation/supply. In this respect, the conventional paper-leaves arrival detecting means does not fulfill its purpose sufficiently.

SUMMARY OF THE INVENTION

The present invention has been developed with a view to eliminating these problems, and it is therefore an object of the invention to provide a paper-leaves separating/supplying method and apparatus, capable of, in feeding paper leaves, reducing the contact pressure occurring between the preceding paper leaf and the succeeding paper leaf to certainly feed the paper leaves one by one for accomplishing the conveyance of the paper leaves with high accuracy without exerting adverse influence on the succeeding paper leaf, such as overlap transportation.

Another object of the invention is to a paper-leaves separating/supplying method and apparatus capable of precisely detecting the paper leaves conveyed up to a paper-leaves feeding position to successively feed the paper leaves with accuracy.

A further object of the present invention is to accurately accomplish the conveyance of paper leaves without troubles such as overlap transportation.

For these purposes, in accordance with a first aspect of the present invention, there is provided a paper-leaves separating/supplying method comprising the steps of placing a belt surface of a separating/supplying belt in a state substantially perpendicular to a conveying direction of a plurality of paper leaves set together and conveyed in a stand-up condition or in a state inclined toward the paper leaves conveyed, taking up the paper leaves, conveyed up to a position at which the paper leaves come into contact with the belt surface, by vacuum suction on the belt surface side so that the paper leaf adheres onto the belt surface, and feeding the one paper leaf taken up toward the downstream side in accordance with the rotary motion of the separating/supplying belt.

Thus, the preceding paper leaf coming previously into contact with the belt surface is attracted and held on the separating/supplying belt in a state parallel with or inclined toward the succeeding paper leaf, and then fed in accordance with the rotary motion of the separating/supplying belt.

Accordingly, the weight of the succeeding paper leaf hardly fall on the preceding paper leaf when the preceding paper leaf is fed to the downstream side, thus minimizing the contact pressure between the preceding paper leaf and the succeeding paper leaf to achieve smooth feeding thereof. In addition, it is possible to prevent the succeeding paper leaf from being dragged by the preceding paper leaf to be disarranged in posture, which assures that the paper leaves are conveyed with accuracy without the occurrence of troubles.

Furthermore, in accordance with a second aspect of the present invention, there is provided a paper-leaves separating/supplying apparatus comprising a rotary separating/supplying belt, vacuum suction means for taking up a plurality of paper leaves, set together and conveyed in a stand-up condition, through the use of vacuum suction so that they are attached onto a belt surface of the separating/supplying belt, and separating/supplying means for feeding the paper leaves, attached onto the belt surface by the vacuum suction, one by one to the downstream side in accordance with the rotary motion of the separating/supplying belt, wherein the belt surface of the separating/supplying belt is placed in a state substantially perpendicular to a conveying direction of the paper leaves or in a state inclined toward the paper leaves. With this construction, the paper leaf (preceding paper leaf) coming previously into contact with the belt surface is sucked to be held on the separating/supplying belt in a state parallel to the paper leaf (succeeding paper leaf) coming afterward or in a state inclined toward the succeeding paper leaf, and fed by the rotary motion of the separating/supplying belt. Accordingly, the weight of the succeeding paper leaf hardly fall on the preceding paper leaf when the preceding paper leaf is fed to the downstream side; therefore, this minimizes the contact pressure between the preceding paper leaf and the succeeding paper leaf to enable the smooth feeding of the paper leaves. In addition, it is possible to prevent the succeeding paper leaf from being dragged together by the preceding paper leaf to be disarranged in posture, which assures that the paper leaves is conveyed with accuracy without the occurrence of troubles.

Still furthermore, in accordance with a third aspect of the present invention, there is provided a paper-leaves separating/supplying method comprising the steps of vacuum-sucking a plurality of paper leaves, set together and conveyed in a stand-up condition, one by one toward a belt surface of a separating/supplying belt of separating/supplying means, bringing a lower end portion of the paper leaf, conveyed to the belt surface, into contact with an auxiliary contact surface placed under the separating/supplying means for feeding the paper leaves to the downstream side in accordance with rotary motion of the separating/supplying belt, attracting the lower end portion of the paper leaf onto the auxiliary contact surface through the use of auxiliary vacuum suction means, and measuring a negative pressure of the auxiliary vacuum suction means for detecting that the paper leaf arrives at the belt surface.

With this method, even though a paper-leaves arrival sensor does not detects that the paper leaf has arrived at the position of the belt surface because it shifts during conveyance, when the paper leaf is brought into contact with the auxiliary contact surface and is attracted thereonto by vacuum suction, the negative pressure exceeds a predetermined value, so the arrival of the paper leaf is detectable on the basis of the measured negative pressure, which secures a continuous paper-leaves feeding operation by the separating/supplying means.

Moreover, in accordance with a fourth aspect of the present invention, there is provided a paper-leaves separating/supplying apparatus comprising separating/supplying means including a rotary separating/supplying belt and first vacuum suction means for vacuum-sucking each of a plurality of paper leaves, set together and conveyed in a stand-up condition, through a belt surface of the separating/supplying belt to suction-hold the paper leaf on the belt surface, with separating/supplying means feeding the paper leaves suction-held on the belt surface one by one to the downstream side in accordance with rotary motion of the separating/supplying belt, auxiliary separation means including an auxiliary contact surface placed under the separating/supplying means for receiving a lower end portion of the paper leaf transferred to the belt surface and second vacuum suction means for generating a vacuum suction force to attract the lower end portion of the paper leaf onto the auxiliary contact surface, a paper-leaves arrival detecting means for detecting the arrival of the paper leaf when the paper leaf is transferred to the belt surface, and negative pressure measuring means for measuring a negative pressure in the second vacuum suction means.

Also with this construction, even though a paper-leaves arrival sensor fails to detect that the paper leaf has arrived at the position of the belt surface because it shifts during conveyance, when the paper leaf is brought into contact with the auxiliary contact surface and is attracted thereonto by the second vacuum suction means, the negative pressure in the second vacuum suction means exceeds a specified value, so the arrival of the paper leaf is detectable on the basis of the measured negative pressure, which secures a continuous paper-leaves feeding operation by the separating/supplying means.

Still moreover, in accordance with a fifth aspect of the present invention, there is provided a paper-leaves separating/supplying method comprising the steps of vacuum-sucking a plurality of paper leaves, set together and conveyed up to a paper-leaves feeding position in a stand-up condition, one by one toward a belt surface of a separating/supplying belt of separating/supplying means, bringing a lower end portion of the paper leaf, transferred to the belt surface, into contact with an auxiliary contact surface placed under the separating/supplying means for feeding the paper leaves to the downstream side in accordance with rotary motion of the separating/supplying belt, attracting the lower end portion of the paper leaf onto the auxiliary contact surface through the use of auxiliary vacuum suction means, when the paper leaf is suction-attracted onto the auxiliary contact surface, making a central portion of the paper leaf protrude to the auxiliary contact surface side and making both sides of the paper leaf warp so that its horizontal cross section forms a generally arch-like configuration.

With this method, the preceding paper leaf is bent into an arch-like configuration so that its both end portions protrude toward the succeeding paper leaf, and at this time, this protrusion of both the end portions of the preceding paper leaf separates the succeeding paper leaf, conveyed in a state brought into contact with the preceding paper leaf, from the preceding paper leaf, thus preventing the overlap transportation of the paper leaves and securing regular conveyance thereof.

In addition, according to this paper-leaves separating/supplying method, air is supplied to the paper leaf, bent into the arch-like configuration, from the under to separate the succeeding paper leaf from the preceding paper leaf. Thus, in addition to the flipping or separation effect stemming from the protrusion of the preceding paper leaf, this air blowing can more certainly achieve the separation between the paper leaves, thus enabling more positively feeding the paper leaves one by one.

Furthermore, in accordance with a sixth aspect of the present invention, there is provided a paper-leaves separating/supplying apparatus comprising separating/supplying means including a rotary separating/supplying belt and first vacuum suction means for vacuum-sucking each of a plurality of paper leaves, set together and conveyed in a stand-up condition to a paper-leaves feeding position, through a belt surface of the separating/supplying belt to suction-hold the paper leaf on the belt surface, with separating/supplying means feeding the paper leaves suction-held on the belt surface one by one to the downstream side in accordance with rotary motion of the separating/supplying belt, and auxiliary separation means including an auxiliary contact surface placed under the separating/supplying means to confront a lower end portion of the paper leaf conveyed to the paper-leaves feeding position and second vacuum suction means for generating a vacuum suction force in the inside of the auxiliary contact surface to attract the lower end portion of the paper leaf onto the auxiliary contact surface, wherein the auxiliary contact surface has an irregular member whereby, when the paper leaf is attracted onto the auxiliary contact surface, a central portion of the paper leaf protrudes toward the auxiliary contact surface side and both end portions thereof protrude toward the succeeding paper leaf coming afterward so that a horizontal cross section of the paper leaf is formed into a generally arch-like configuration.

Likewise, with this construction, the preceding paper leaf is bent into an arch-like configuration so that its both end portions protrude toward the succeeding paper leaf, and at this time, this protrusion of both the end portions of the preceding paper leaf separates the succeeding paper leaf, conveyed in a state brought into contact with the preceding paper leaf, from the preceding paper leaf, thus preventing the overlap transportation of the paper leaves and securing regular conveyance thereof.

In addition, according to this paper-leaves separating/supplying apparatus, the auxiliary contact surface is disposed to make a predetermined angle between the auxiliary contact surface and the belt surface of the separating/supplying belt so that the paper leaf attracted onto the auxiliary contact surface is bent toward the succeeding paper leaf. Accordingly, the paper leaf bent into the arch-like configuration is further bent into a doglegged configuration to form a gap with respect to the succeeding paper leaf, thereby more positively securing the separation between the preceding paper leaf and the succeeding paper leaf.

Still additionally, the irregular member of the auxiliary contact surface is formed so that its lower end portion has a flat configuration. This structure makes a larger gap between the lowermost portion of the paper leaf attracted onto the auxiliary contact surface and the succeeding paper leaf, which enables more efficient separation of the preceding paper leaf from the succeeding paper leaf when air is supplied into the enlarged gap between the preceding paper leaf and the succeeding paper leaf.

Furthermore, in accordance with a sixth aspect of the present invention, there is provided a paper-leaves separating/supplying apparatus comprising separating/supplying means including a rotary separating/supplying belt and first vacuum suction means for vacuum-sucking each of a plurality of paper leaves, set together and conveyed in a stand-up condition to a paper-leaves feeding position, through a belt surface of the separating/supplying belt to suction-hold the paper leaf on the belt surface, with separating/supplying means feeding the paper leaves suction-held on the belt surface one by one to the downstream side in accordance with rotary motion of the separating/supplying belt, and auxiliary separation means including an auxiliary contact surface placed under the separating/supplying means to confront a lower end portion of the paper leaf conveyed to the paper-leaves feeding position, second vacuum suction means for generating a vacuum suction force in the inside of the auxiliary contact surface to attract the lower end portion of the paper leaf onto the auxiliary contact surface and an irregular member whereby, when the paper leaf is attracted onto the auxiliary contact surface, a central portion of the paper leaf protrudes toward the auxiliary contact surface side and both end portions thereof protrude toward the succeeding paper leaf coming afterward so that a horizontal cross section thereof is warped in a generally arch-like configuration, and air blowing means for supplying air between the preceding paper leaf and the succeeding paper leaf from under the paper leaves to make separation between the preceding paper leaf, attracted onto the auxiliary contact surface, and the succeeding paper leaf.

With this construction, the preceding paper leaf is bent into an arch-like configuration so that its both end portions protrude toward the succeeding paper leaf, and at this time, this protrusion of both the end portions of the preceding paper leaf separates the succeeding paper leaf, conveyed in a state brought into contact with the preceding paper leaf, from the preceding paper leaf. In addition, air is supplied between the preceding paper leaf and the succeeding paper leaf, thus achieving more positive separation between the preceding paper leaf and the succeeding paper leaf and securing regular conveyance thereof.

Moreover, the irregular member is made so that its lowermost portion corresponding to the lowermost portion of the paper leaf brought into contact with the auxiliary contact surface has a flat configuration. This structure makes a larger gap between the lowermost portion of the paper leaf attracted onto the auxiliary contact surface and the succeeding paper leaf, which enables more efficient separation of the preceding paper leaf from the succeeding paper leaf when air is supplied into the enlarged gap between the preceding paper leaf and the succeeding paper leaf.

BRIEF DESCRIPTION OF THE DRAWINGS

Other objects and features of the present invention will become more readily apparent from the following detailed description of the preferred embodiments taken in conjunction with the accompanying drawings in which.

DESCRIPTION OF THE PREFERRED EMBODIMENTS

An embodiment of the present invention will be described hereinbelow with reference to the drawings.

Figure 1:
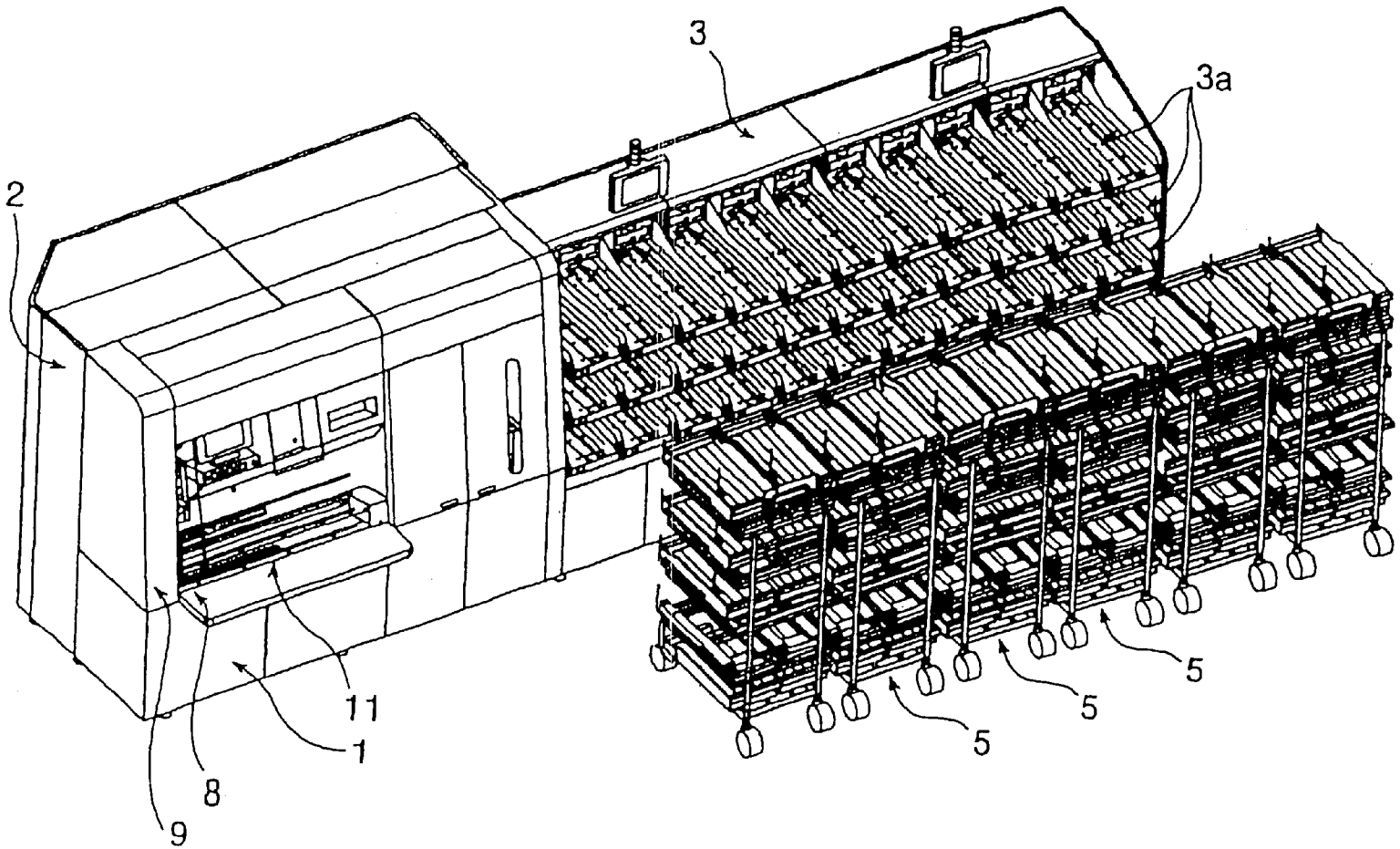
FIG. 1 is a perspective view showing the entire construction of a paper-leaves division system according to an embodiment of the present invention.
Figure 2:
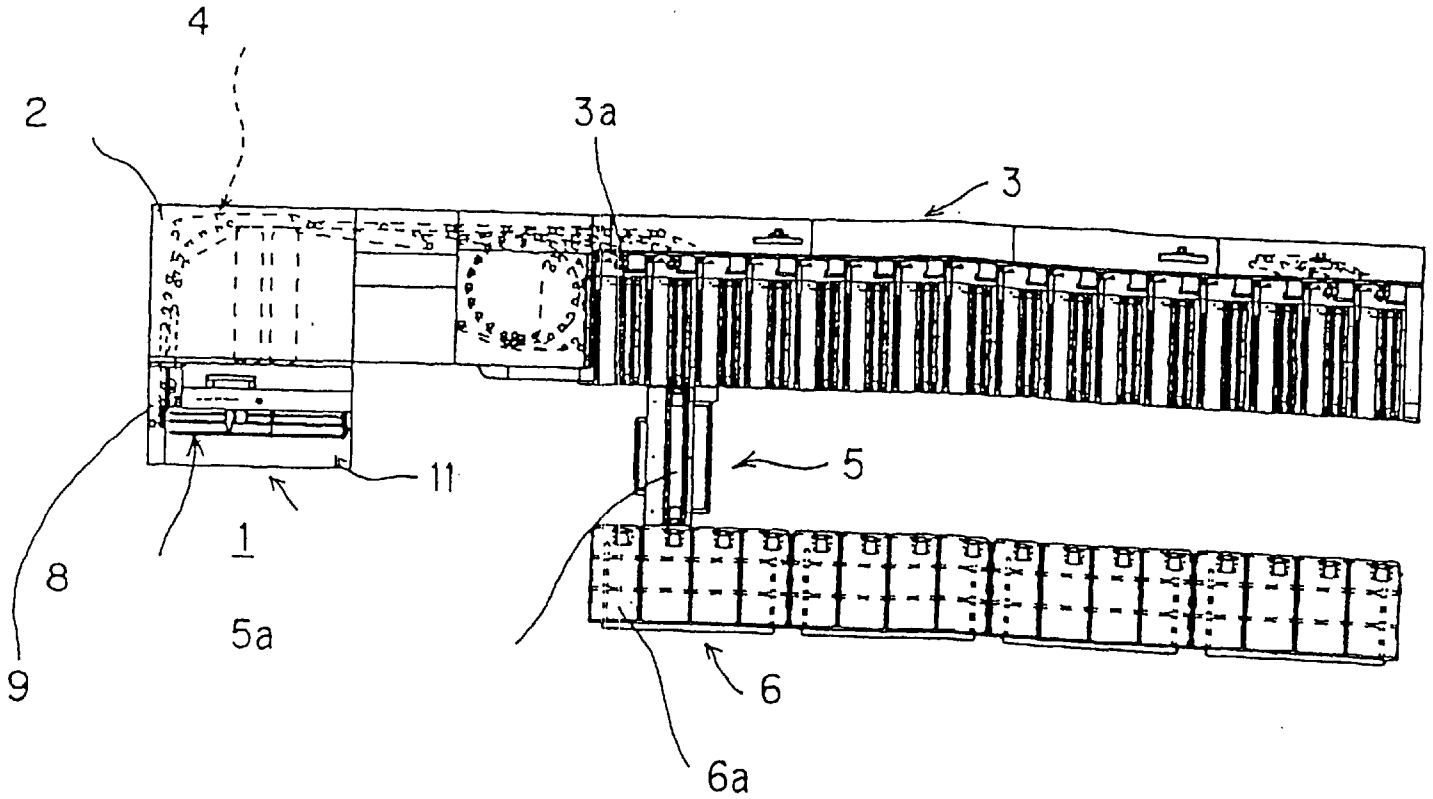
FIG. 2 is a plan view showing the entire construction of the paper-leaves division system according to this embodiment.
Figure 3:
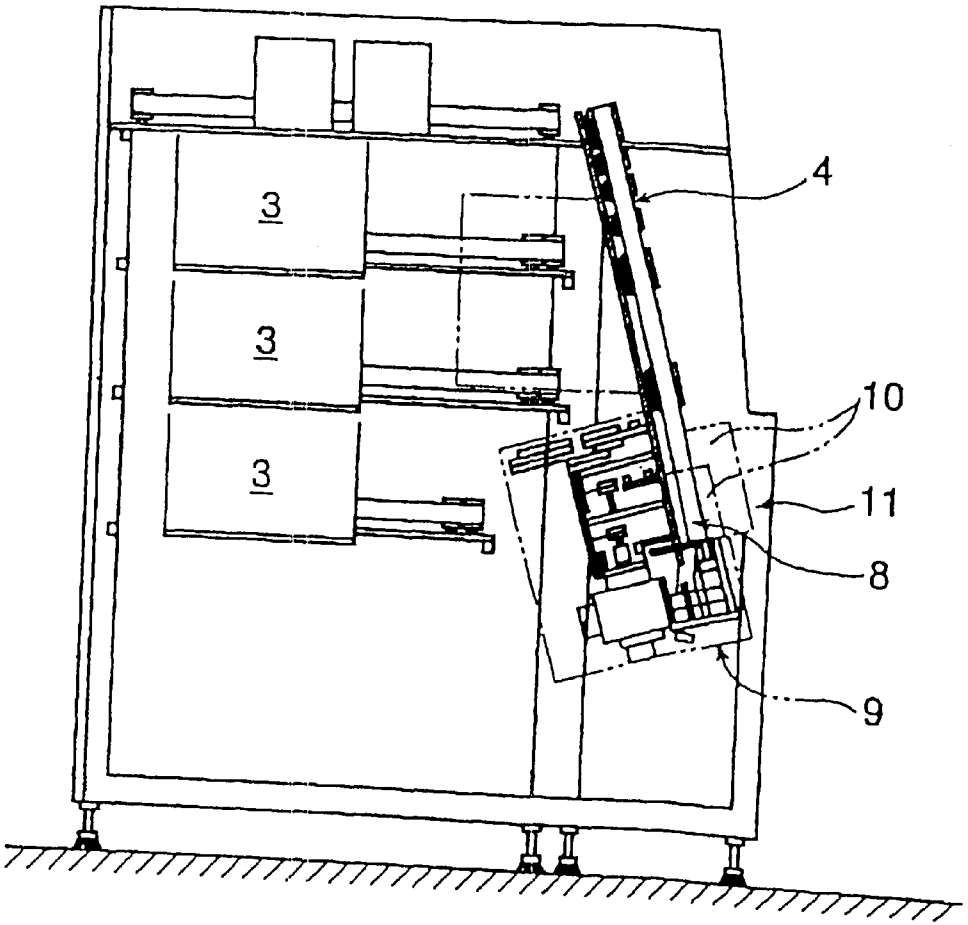
FIG. 3 is a schematic illustration of a composition of the interior of the paper-leaves division system according to the embodiment, viewed perceptively from a side direction.

FIG. 1 is a perspective view showing the entire construction of a paper-leaves division system using a paper-leaves separating/supplying apparatus according to a first embodiment of the present invention, FIG. 2 is a plan view showing the entire construction of this paper-leaves division system, and FIG. 3 is a schematic illustration of a composition of the interior of this paper-leaves division system, viewed perceptively from a side direction.

(A) Entire Construction of Paper-Leaves Division System

In FIGS. 1 to 3, this paper-leaves division system is roughly made up of a paper-leaves supplying section 1, a reading unit 2, a paper-leaves partitioning section 3, a paper-leaves conveying means 4, a transfer truck 5, a storage shelf 6 and others.

The paper-leaves supplying section 1 is for conveying a plurality of paper leaves 10 (see FIGS. 3, 20A and 20B), set together in a bundle and in a stand-up posture, to up a paper-leaves feeding position 8, and a paper-leaves separating/supplying apparatus 9, placed at the paper-leaves feeding position 8, is for separating the paper leaves 10 from each other and feeds them successively to the downstream side at which the reading unit 2 exists. The reading unit 2 reads the destination information of a bar code (alternatively, a postal code or the like) attached to each of the paper leaves 10 separated from each other in the paper-leaves separating/supplying apparatus 9, and sends that destination information to a computer.

The paper-leaves partitioning section 3, in this embodiment, is constructed into a three-step arrangement in a vertical direction. The paper-leaves partitioning section 3 includes a plurality of (in this embodiment, 33) partitioning/stacking units 3*a* for temporarily accumulating and storing the paper leaves 10 divided and distributed on the basis of the destination information, in a state aligned in a horizontal direction.

The paper-leaves conveying means 4 is for conveying the paper leaves 10, fed one by one from the paper-leaves separating/supplying apparatus 9 of the paper-leaves supplying section 1, through the reading unit 2 to the paper-leaves partitioning section 3. In front of (on the upstream side of) each of the partitioning/stacking units 3*a* of the paper-leaves partitioning section 3, there is placed a distributing section (not shown) for distributing the paper leaves 10 to the partitioning/stacking unit 3*a*, disposed in the form of three stages, of the paper-leaves partitioning section 3.

The transfer truck 5 accepts and accommodates the paper leaves 10 discharged from the partitioning/stacking units 3*a* of the paper-leaves partitioning section 3, and a paper-leaves relaying passage 5*a*, constructed into a vertical three-step arrangement, is provided to each of the partitioning/stacking units 3*a* of the paper-leaves partitioning section 3.

The storage shelf 6 is constructed into a three-stage arrangement according to the partitioning/stacking units 3*a* of the paper-leaves partitioning section 3, and is such that paper-leaves storage passages 6*a* are lined up in a horizontal direction, with each line comprising eleven paper-leaves storage passages 6*a*.

(A-1) Outline of Construction of Paper-Leaves Supplying Section

Figure 4:
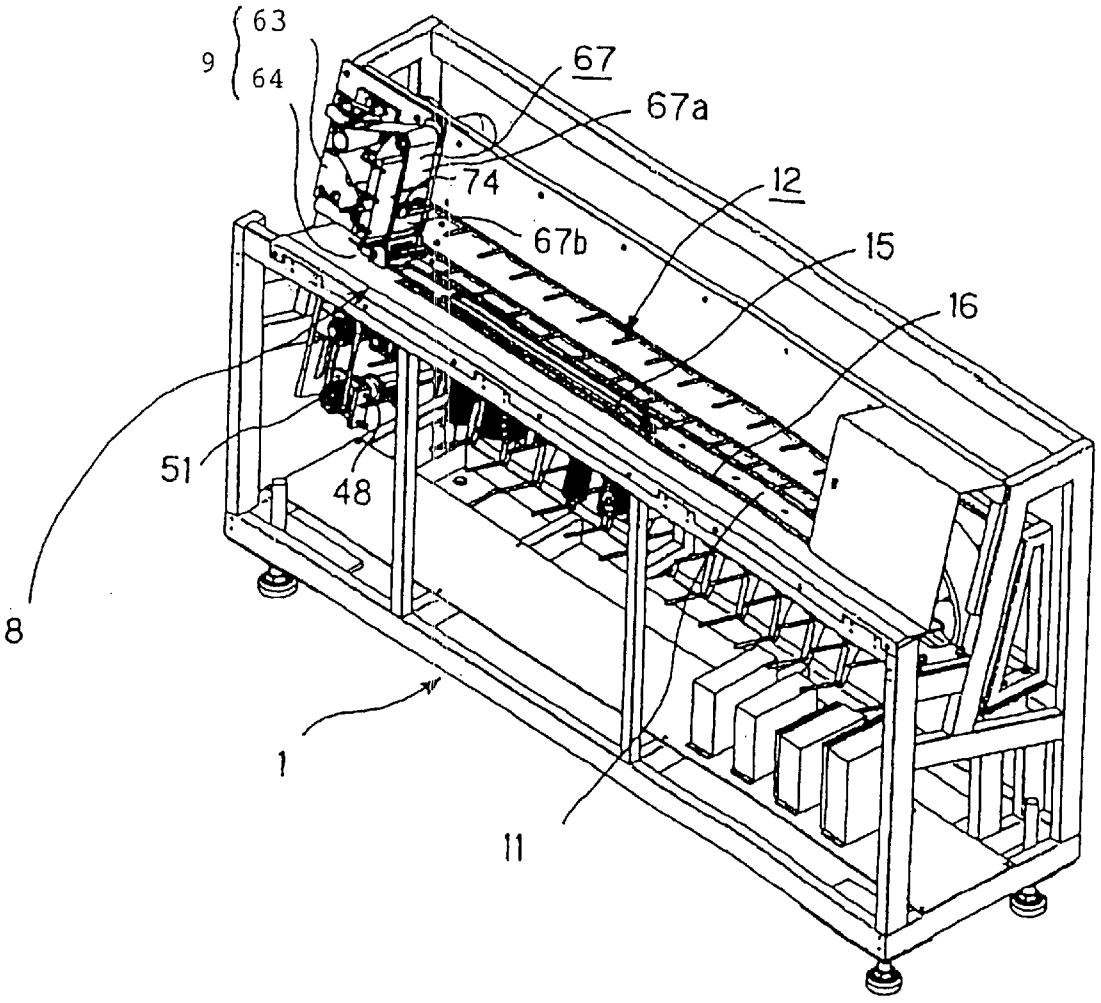
FIG. 4 is a perspective view showing an essential construction of a paper-leaves supplying section of the paper-leaves division system according to the embodiment.
Figure 5:
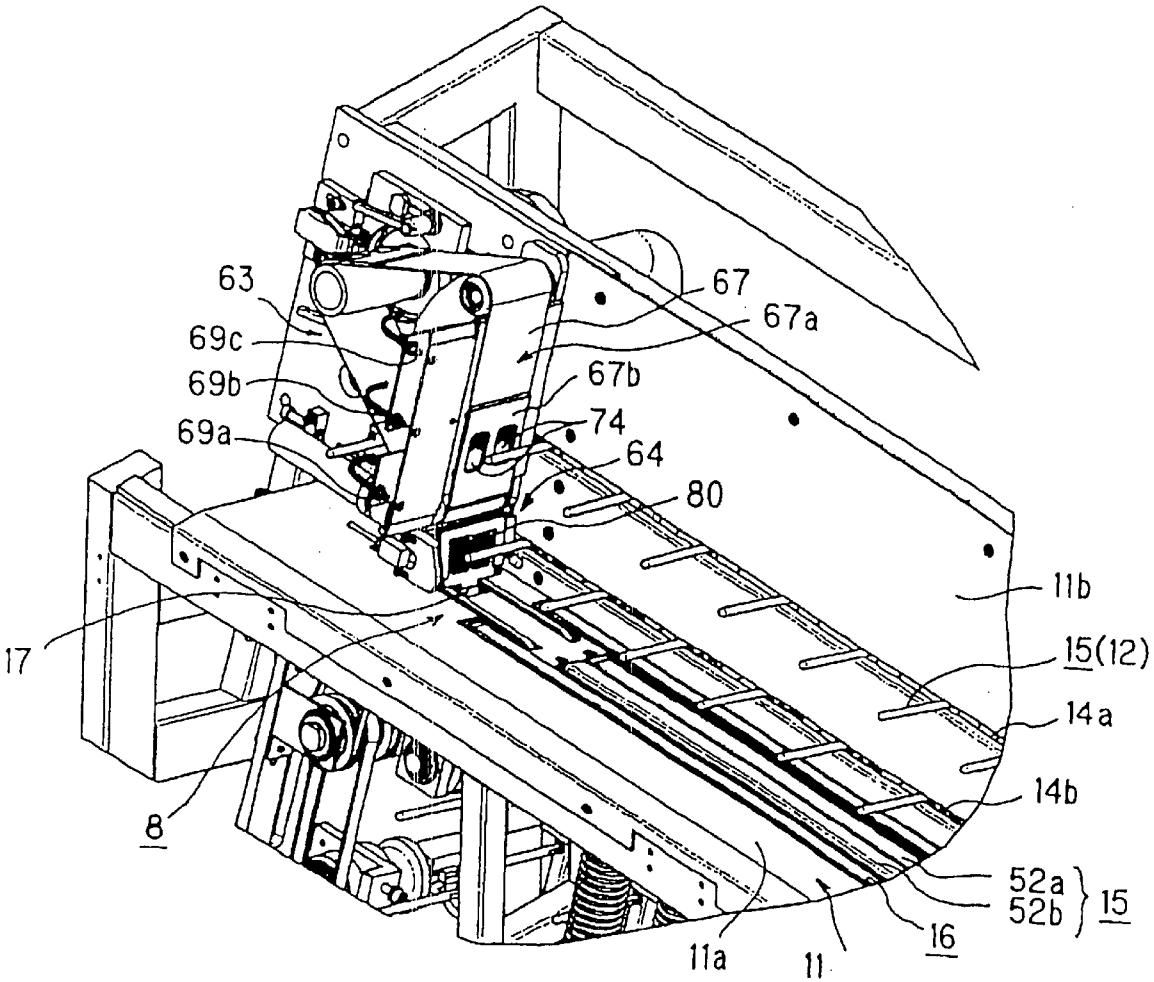
FIG. 5 is a perspective view showing an essential construction of the paper-leaves division system according to the embodiment.

FIG. 4 is a perspective view showing an essential construction of the paper-leaves supplying section 1, and FIG. 5 is an partially enlarged and perspective view showing a construction around the paper-leaves feeding position 8 in the paper-leaves supplying section 1. In FIGS. 4 and 5, the paper-leaves supplying section 1 is equipped with a depositing section 11 in which a plurality of paper leaves 10 bundled are deposited in a stand-up posture.

(A-2) Construction of Depositing Section

Figure 6:
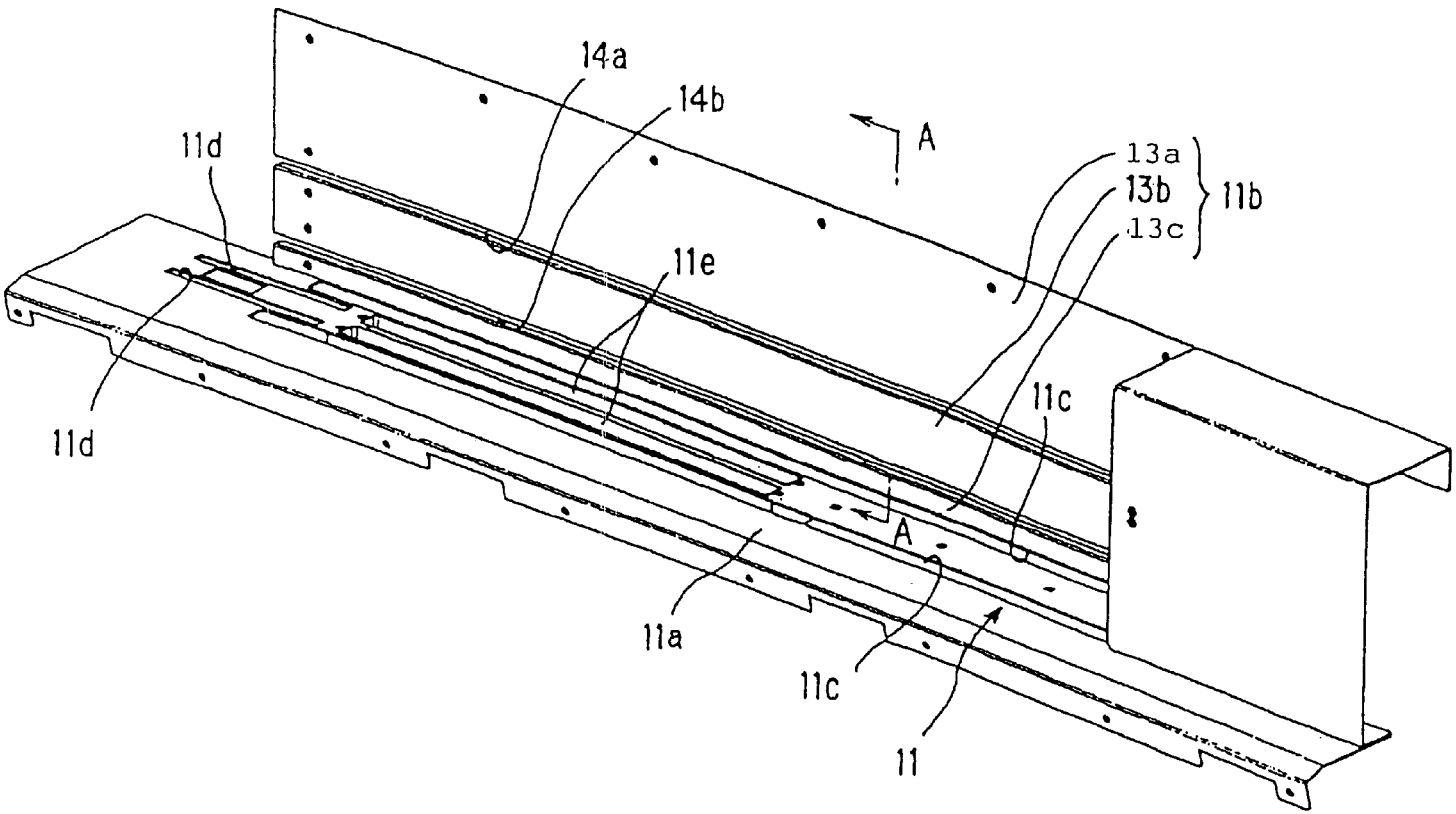
FIG. 6 is a perspective view showing an essential construction of a depositing section of the paper-leaves division system according to the embodiment.
Figure 7:
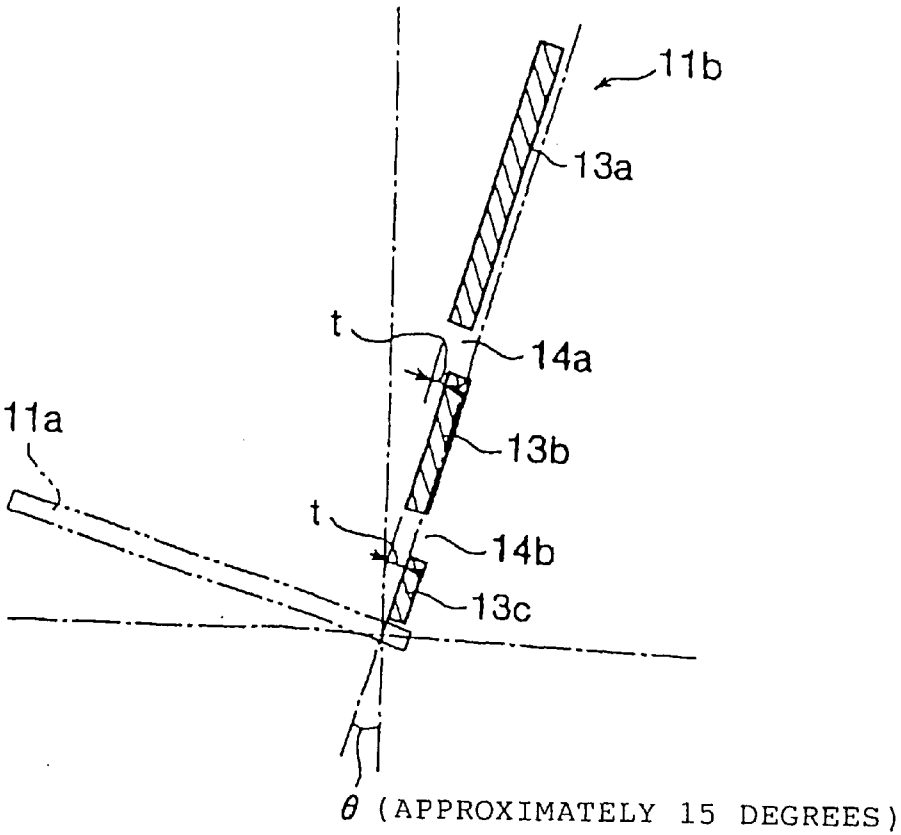
FIG. 7 is a schematic cross-sectional view taken along a line A—A of FIG. 6.

The depositing section 11, as shown in FIGS. 6 and 7, is composed of a bottom wall 11*a* for supporting the bottom surfaces of the deposited paper leaves 10 and a back wall 11*b* for supporting the back surface portions of the paper leaves 10. The bottom wall 11*a* and the back wall 11*b* are made to intersect with each other at generally right angles to form a generally L-shaped cross section, and the entire back wall 11*b*, together with the bottom wall 11*a*, is set in a state inclined or turned backwardly by θ degrees (approximately 15 degrees) (see FIGS. 3 and 7). FIG. 6 is a perspective view schematically showing an essential construction of the depositing section 11, and FIG. 7 is an illustrative cross-sectional view taken along a line A—A of FIG. 6.

A further description will be given hereinbelow of a peripheral structure of the depositing section 11.

On the back wall 11*b* side, a paper-leaves conveying means 12 is provided which is capable of sending the paper leaves 10 on the depositing section 11 toward the paper-leaves feeding position 8 horizontally in a stand-up condition. In addition, the back wall 11*b* is formed in a manner that three plates of an upper back plate 13*a*, an intermediate back plate 13*b* and a lower back plate 13 are combined into one back wall in a state where slits 14*a* and 14*b* are defined between the upper back wall 13*a* and the intermediate back plate 13*b* and between the intermediate back plate 13*b* and the lower back plate 13*c*, respectively. The back plates 13*a* to 13*c* are made to have different widths, that is, the upper back wall 13*a* is wider in width than the intermediate back plate 13*b* while the intermediate back plate 13*b* is wider than the lower back wall 13*c*. Still additionally, the back plates 13*a* to 13*c* are not placed on the same plane, but are, as shown in FIG. 7, disposed stepwise so that the intermediate back plate 13*b* is slightly set backwardly by a distance "t" with respect to the upper back plate 13*a*, while the lower back plate 13*c* is slightly set backwardly by a distance "t" with respect to the intermediate back plate 11*b*, that is, so that the back wall 11*b* recedes successively as it approaches the bottom wall 11*a*. The reason that the positions of the three back plates 13*a* to 13*c* having different widths and constituting the back wall 11*b* are successively shifted rearwardly in this way is to, when the paper leaves 10 being vibrated to be put in order jump up and then drop, prevent the corners (intersections between the bottom surfaces and the back surfaces) of the paper leaves 10 from being caught by the upper surfaces of the back plates 13*b* and 13*c* constituting the slits 14*a* and 14*b* to cause the paper leaves 10 to be put in disorder. That is, in a case in which the back plates 13*a* to 13*c* disposed to define the slits 14*a* and 14*b* are disposed on the same plane, the back plate 13*c* tends to develop a protrusive step, and when the paper leaves 10 drop along the back wall 11*b* in this state, the paper leaves 10 are blocked by the protrusive step so that they turn, thereby being put in disorder. On the other hand, in this embodiment, in a case in which the back plates 13*a* to 13*c* are disposed to stepwise recede more backwardly as the position in the back wall 11*b* approaches the bottom side, such a protrusive step disappears. Accordingly, the paper leaves 10 come down along the back plate 13*a* smoothly drop to the bottom wall 11*a* without being caught by the upper surfaces of the back plates 13*b* and 13*c*, thus certainly putting the paper leaves 10 in order without disorder during the arrangement thereof. Moreover, even if the paper leaves 10 are returned while being turned clockwise in FIG. 7, since each of the upper surfaces of the back plates 13*b* and 13*c* is shifted backwardly with respect to the back plate 13*a* or 13*b* just above, it is possible to prevent the paper leaves 10 from being caught by the corners thereof, which secures the certain arrangement of the paper leaves 10 without again disordering them during the arrangement.

Furthermore, on the bottom wall 11*a* side, there are provided a paper-leaves vibrating means 15 (see FIGS. 4, 5 and 19) for vibrating the paper leaves 10 placed on the depositing section 11 to brought two edges (lower side edges and back side edges) of the paper leaves 10 into contact with the bottom wall 11*a* and the back wall 11*b* for arranging the paper leans 10 and a second paper-leaves conveying means 16 for horizontally sending the paper leaves 10 on the depositing section 11 to the paper-leaves feeding position 8 in a stand-up condition in cooperation with the paper-leaves conveying means 12.

(A-3) Construction of Paper-Leaves Conveying Means

Figure 8:
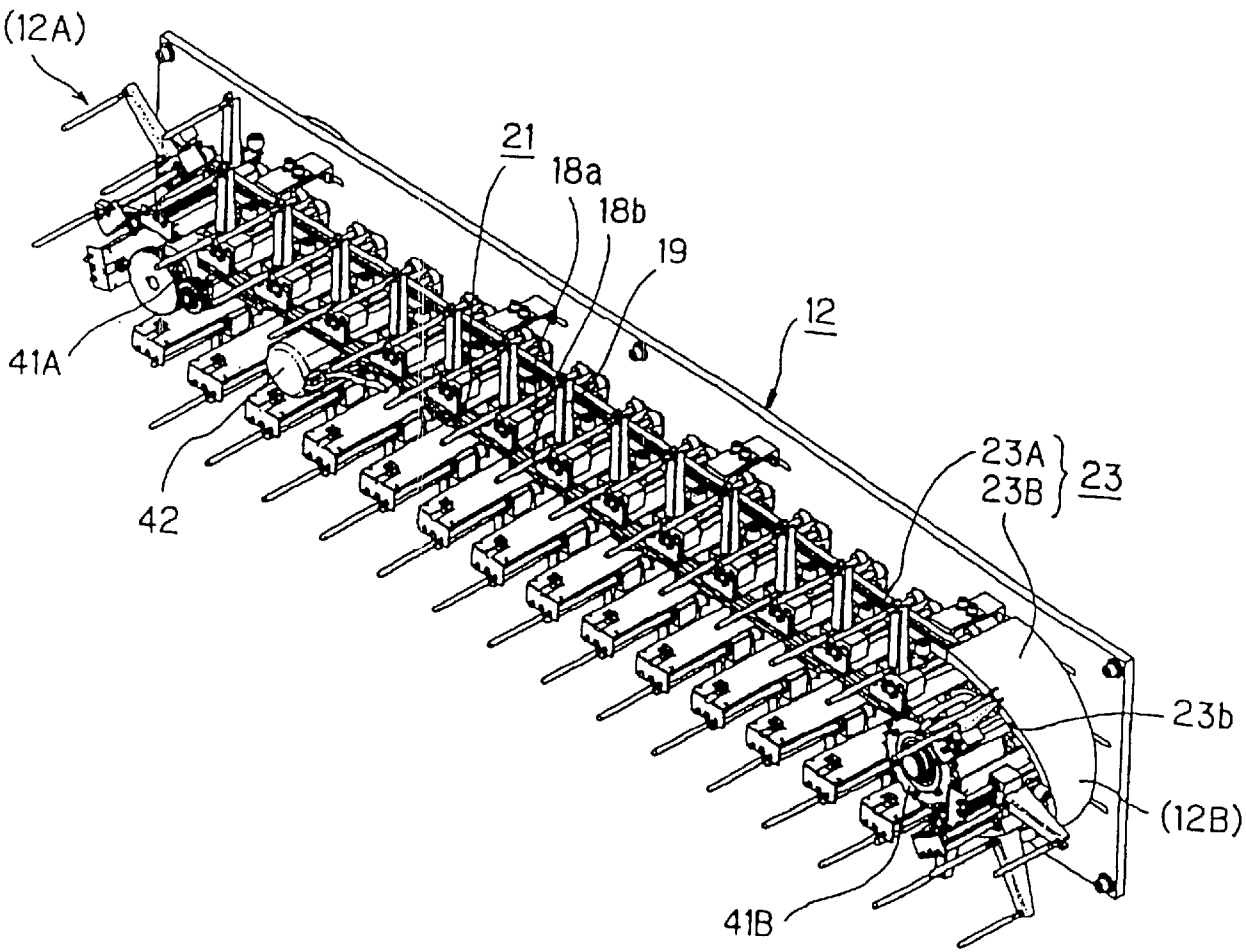
FIG. 8 is a perspective view entirely showing a paper-leaves conveying means of the paper-leaves division system according to the embodiment.

As FIG. 8 shows generally, the aforesaid paper-leaves conveying means 12 is composed of an endless chain 21 for successively joining, through chains 20, partitioning arm devices 19, each having two upper and lower arms 18*a* and 18*b* passing through the slits 14*a* and 14*b* of the back wall 11*b* and forwardly protruding at generally right angles from the back wall 11*b*, into an endless condition and disposing them at a substantially equal interval, a driving means 22 for placing this endless chain 21 in rotary motion, a cam device 23 for controlling the advancing/retracting operations of the partitioning arm devices 19 in placing the endless chain 21 in rotary motion, and other components. The driving means 22 includes a motor 42 as a drive source. In addition, the partitioning arm devices 19 are for subdividing the paper leaves 10, deposited together in the depositing section 11, in the depositing section 11 and for supporting the subdivided paper leaves 10 from both the sides to hold them in a stand-up condition, and further conveying them to the paper-leaves feeding position 8 in this condition in cooperation with a second paper-leaves conveying means 16 which will be mentioned later. When positioned on the upper half side of the endless chain 21 by the rotary motion of the endless chain 21, the arms 18*a* and 18*b* of each of the partitioning arm devices 19 pass through the slits 14*a* and 14*b* and move toward the paper-leaves feeding position 8 in a state protruding forwardly at generally right angles from the back wall 11*b*, and when arriving at a position (end portion 12A) immediately before the paper-leaves feeding position 8, retract backwardly from the back wall 11*b*. Thereafter, they are positioned on the lower half side of the endless chain 21 turned downwardly to move toward an end portion 12B opposite to the paper-leaves feeding position 8, and are again turned upwardly from the end portion 12B. Still additionally, immediately before the end portion 12B, the arms 18*a* and 18*b* of the partitioning arm device 19 are guided by the cam device 23 to again pass through the slits 14*a* and 14*b* for protruding forwardly from the back wall 11*b*, and then are guided to move toward the paper-leaves feeding position 8 on the upper half side of the endless chain 21.

(A-4) Structure of Cam Device

Figure 9:
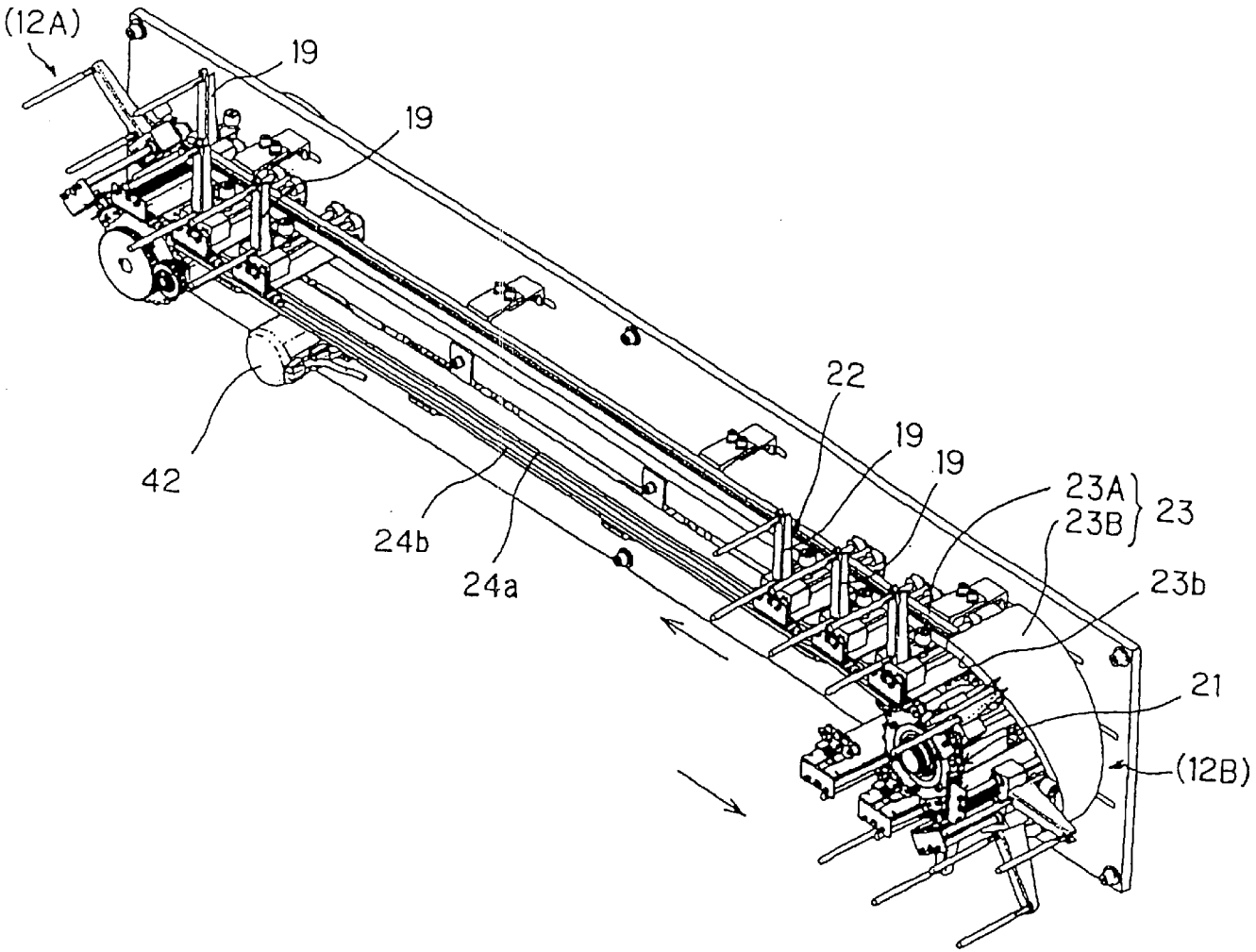
FIG. 9 is a perspective view showing an essential construction of the paper-leaves conveying means of the paper-leaves division system according to the embodiment.
Figure 10:
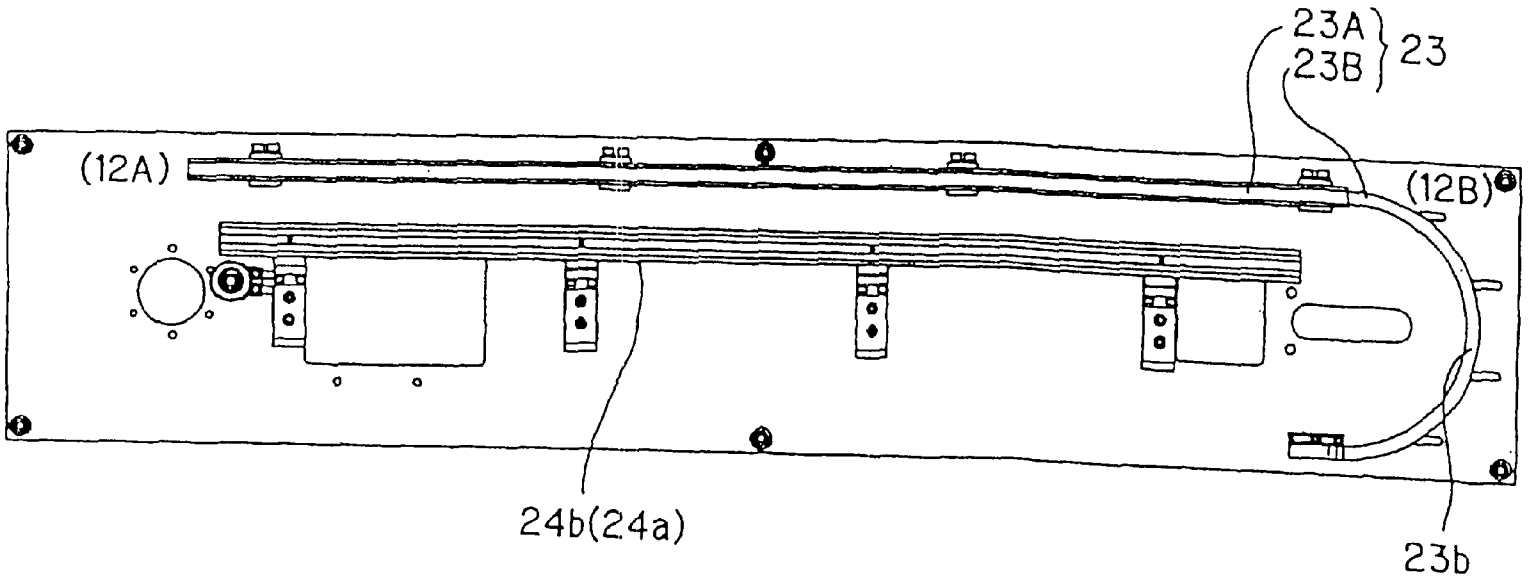
FIG. 10 is a front elevational view showing the essential construction of the paper-leaves conveying means of the paper-leaves division system according to the embodiment.
Figure 11:
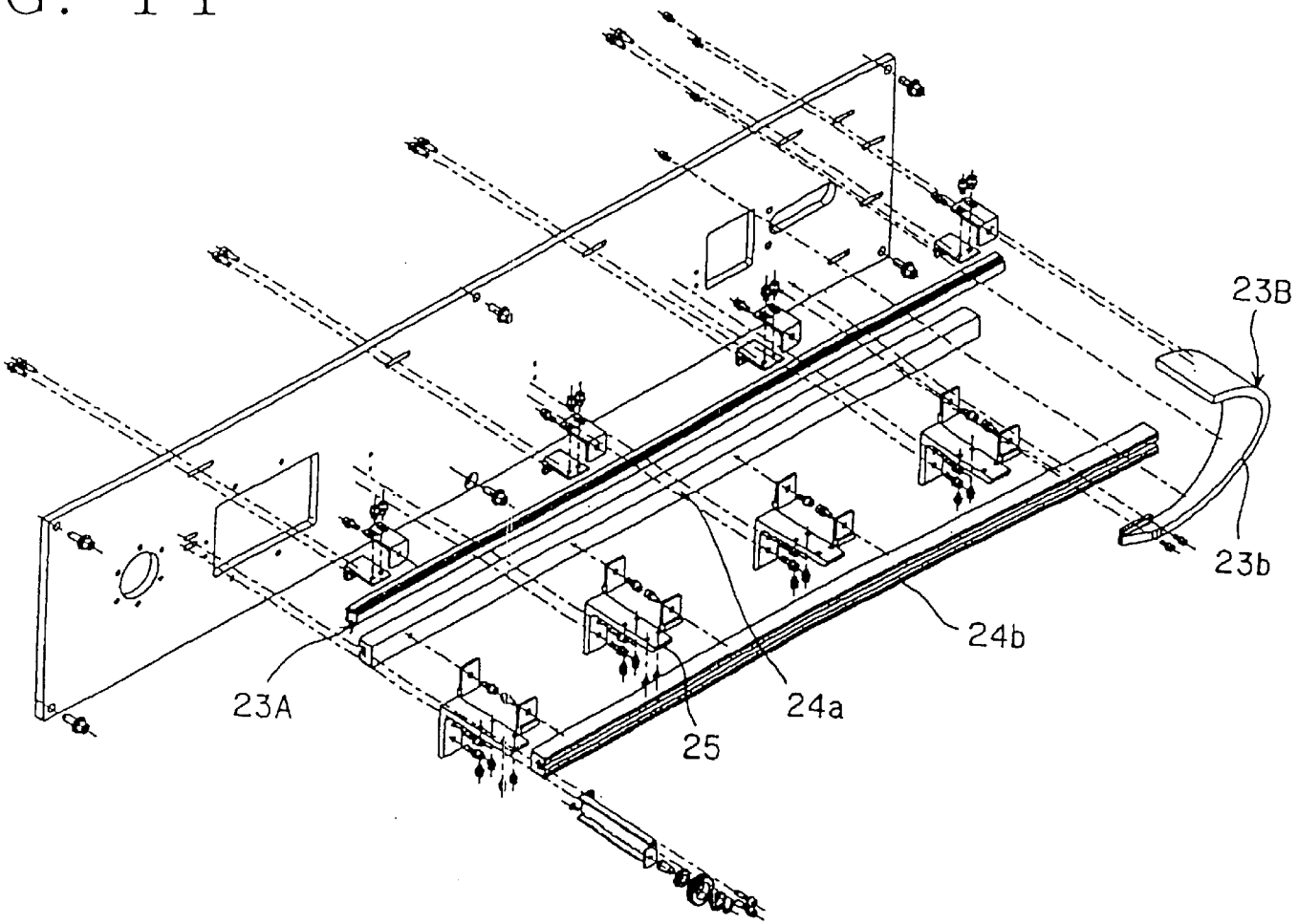
FIG. 11 is an exploded perspective view showing the essential construction of the paper-leaves conveying means of the paper-leaves division system according to the embodiment.
Figure 12:
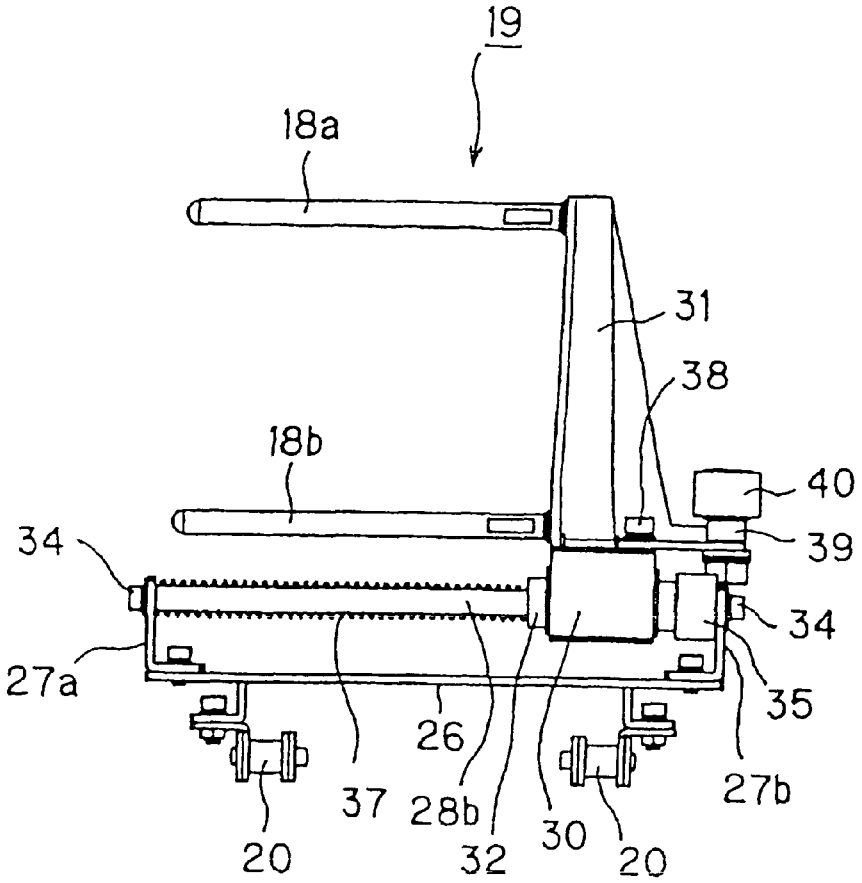
FIG. 12 is a side elevational view showing a partitioning arm device of the paper-leaves conveying means of the paper-leaves division system according to the embodiment.
Figure 13:
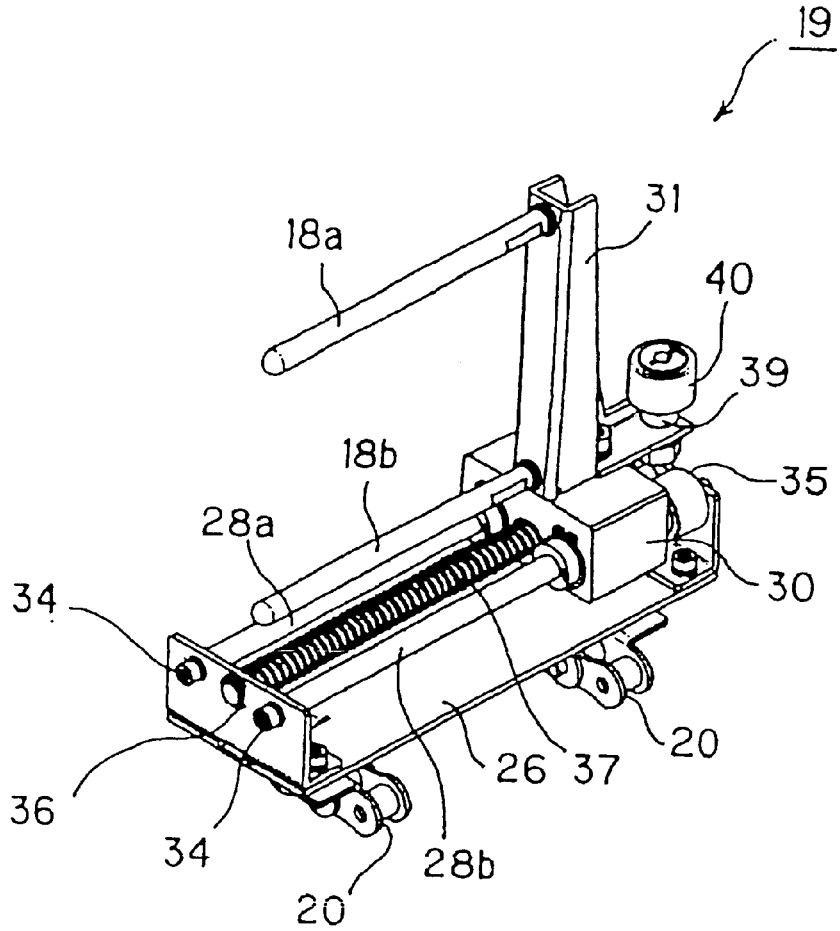
FIG. 13 is a perspective view showing the partitioning arm device of the paper-leaves conveying means of the paper-leaves division system according to the embodiment.

As shown in detail in FIGS. 9 to 11, the cam device 23 is composed of a first cam 23A disposed along the traveling path of the partitioning arm devices 19 guided on the upper half side of the endless chain 21, and a second cam 23B disposed along the traveling path of the partitioning arm device 19 at the end portion 12B of the endless chain 21 opposite to the paper-leaves feeding position 8. The second cam 23B has a generally U-like configuration and an inclined surface 23*b* tilted so that it gradually protrudes forwardly as the turning to the upper side proceeds, and the inclined surface 23*b* is made to shows the maximum protrusion quantity at the time of the completion of the turning to the upper side. On the other hand, the first cam 23A is made in the form of one rail member having a column-like configuration, and is disposed in a state continuously joined to an end portion (the maximum protruding portion of the inclined surface 23*b*) of the second cam 23B and extends straight toward the paper-leaves feeding position 8 (end position 12A) in a state where the maximum protrusion quantity is maintained. On the paper-leaves feeding position 8 side, the first cam 23A is positioned so that a roller 40 of the partitioning arm device 19 is brought into contact therewith until the arms 18*a* and 18*b* of the partitioning arm device 19 moved to the nearest position to the paper-leaves feeding position 8, accommodating one or more paper leaves 10 therebetween, come to a position immediately before coming into contact with a belt contact surface 67*a* of a separating/supplying belt 67 of the paper-leaves separating/supplying apparatus 9. In the vicinity of the location of the first cam 23A, a pair of guide bars 24*a* and 24*b* are placed along the first cam 23A (see (FIGS. 10 and 11). The pair of guide bars 24*a* and 24*b* are held in parallel with each other through a spacer 25 fixed on the apparatus body side to support, from the under, the upper half of the endless chain 21 traveling toward the paper-leaves feeding position 8 in a state brought into contact with the first cam 23A after the completion of the turning from the lower side.

(A-5) Construction of Partitioning Arm Device

As shown in detail in FIGS. 12 to 17, the partitioning arm device 19 is composed of a fitting plate 26 fixedly secured to extend between a pair of chains 20, a pair of guide bars 28*a*, 28*b* and center bar 29 whose both end portions are fixed to brackets 27*a* and 27*b* fixed to both end portions of the fitting plate 26, a slider 30 attached to the guide bars 28*a*, 28*b* and the center bar 29 to be slidable forwardly and backwardly, an arm holder 31 fixedly secured onto the slider 30, the aforesaid pair of arms 18*a* and 18*b* fixedly secured onto the arm holder 31, and other components. The slider 30, as shown in the exploded perspective view of FIG. 15, has through holes 30*a* and 30*b* made at right and left positions and a through-hole 30*c* made at a central position. A cylindrical slide bush 32 is inserted into each of the through holes 30*a* and 30*b*, and the slide bush 32 is fixed to the slider 30 through snap rings 33 mounted over the slide bush 32 before and after the slider 30. In addition, the guide bars 28*a* and 28*b* penetrate the slider 30 after passing through the slide bushes 32, and both end portions thereof fixedly secured to the brackets 27*a* and 27*b* by means of vises 34 so that the slider 30 is slidable forwardly and backwardly. In this case, when the slider 30 are fitted over the guide bars 28*a* and 28*b*, a ring-like spacer 35 is placed between the slider 30 and the bracket 27*b* in order to limit the sliding amount of the slider 30. The center bar 29 penetrates the through hole 30*c* of the slider 30 and is disposed to be in parallel with the guide bars 28*a* and 28*b*, and both the end portions thereof penetrate the brackets 27*a* and 27*b*, respectively, and are positioned by E rings 36 in the exterior of the brackets 27*a* and 27*b*. Moreover, a coil spring 37 is set on the center bar 29 between the bracket 27*a* and the slider 30 in a state compressed to press the slider 39 against the bracket 27*b* side at all times (see FIGS. 12 and 13). The arm holder 31 has a generally L-shaped configuration, and a vertical portion 31*a* is turned forwardly and a horizontal portion 31*b* bent backwardly from the lower end side of the vertical portion 31*a* at substantially right angles is fixedly secured onto the upper surface of the slider 30. The pair of arms 18*a* and 18*b* separated vertically is fitted to the vertical portion 31*a* in a state of protruding forwardly at substantially right angles. On the other hand, the roller 40 is fitted to the rear end side of the horizontal portion 31*b* to be rotatable horizontally around a rotary shaft 39 extending upwardly at right angles from the horizontal portion 31*b*. This roller 40 is in conjunction with the first cam 23A and the second cam 23B, and is allowed to come into contact with the first cam 23A and the second cam 23B.

The driving means 22 is equipped with rotary drums 41A and 41B rotatably disposed separately right and left end portions of the depositing section 11, with toothed wheels (not shown) to be engaged with the chains 20 being formed on the outer circumferences of the rotary drums 41A and 41B. In addition, on the rotation of the rotary drums 41A and 41B, the toothed wheels are successively engaged with the chains 20 so that the endless chain 21, together with the partitioning arm devices 19, travels endlessly in the rotating direction of the rotary drums 41A and 41B. Of the rotary drums 41A and 41B, the rotary drum 41A acts as a driving drum while the rotary drum 41B acts as an idler drum, and the rotary drum 41A is made to rotate in response to a rotational driving force from a motor 42. That is, the rotation of the motor 42 causes the rotation of the rotary drum 41A, and makes the rotation of the rotary drum 41B according to the rotation of the rotary drum 41A through the chains 20, thus accomplishing the endless rotation of the endless chain 21.

Secondly, a description will be given hereinbelow of an operation of the partitioning arm device 19 in the construction of the aforesaid paper-leaves conveying means 12.

Figure 14:
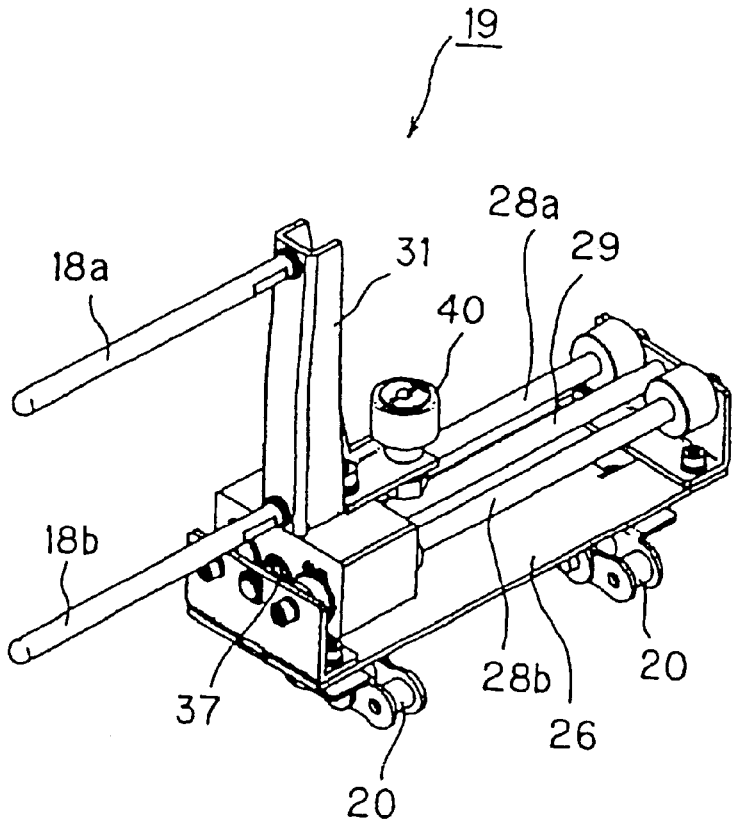
FIG. 14 is a perspective view showing the partitioning arm device of the paper-leaves conveying means of the paper-leaves division system according to the embodiment.
Figure 15:
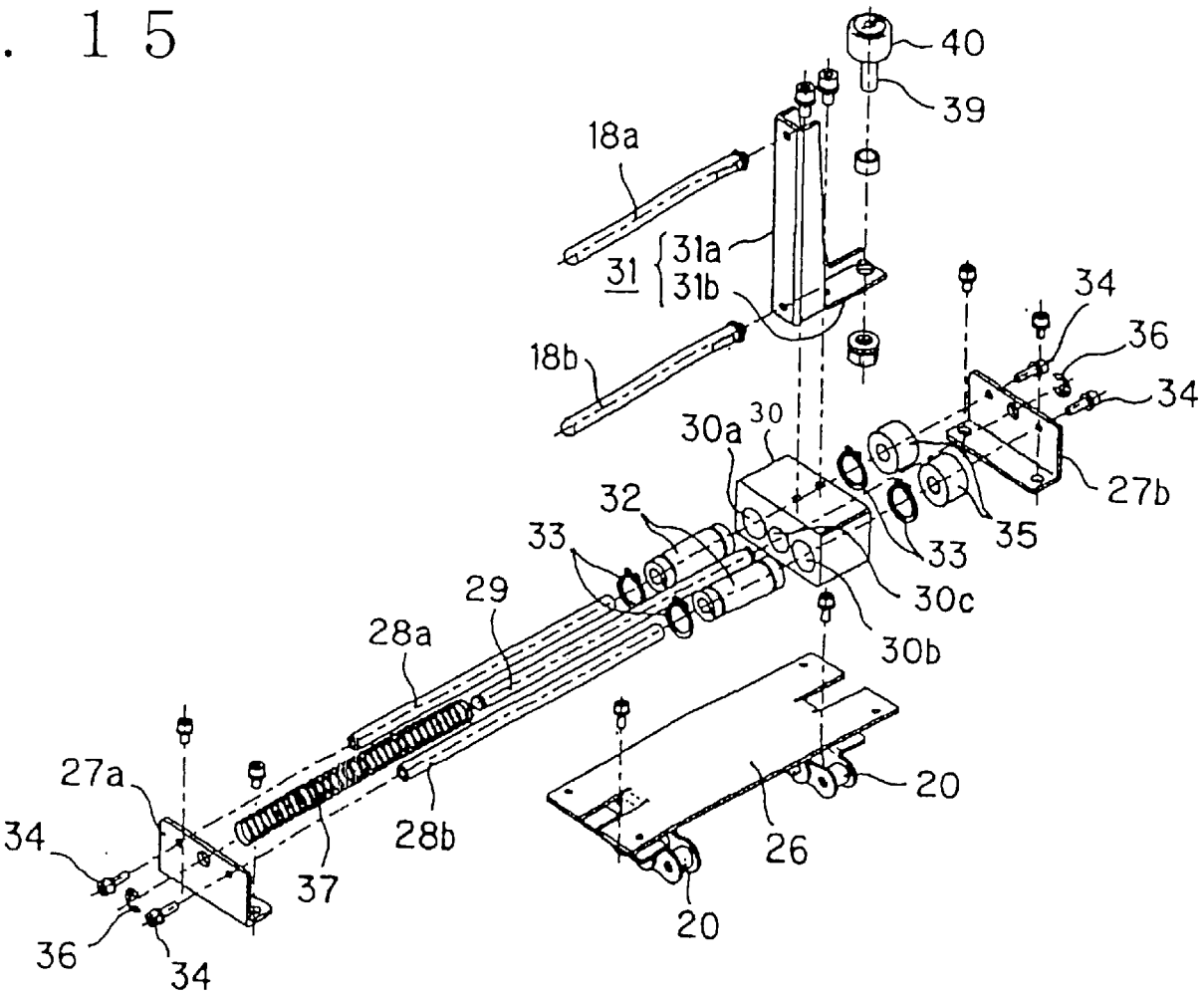
FIG. 15 is an exploded perspective view showing the partitioning arm device of the paper-leaves conveying means of the paper-leaves division system according to the embodiment.
Figure 16:
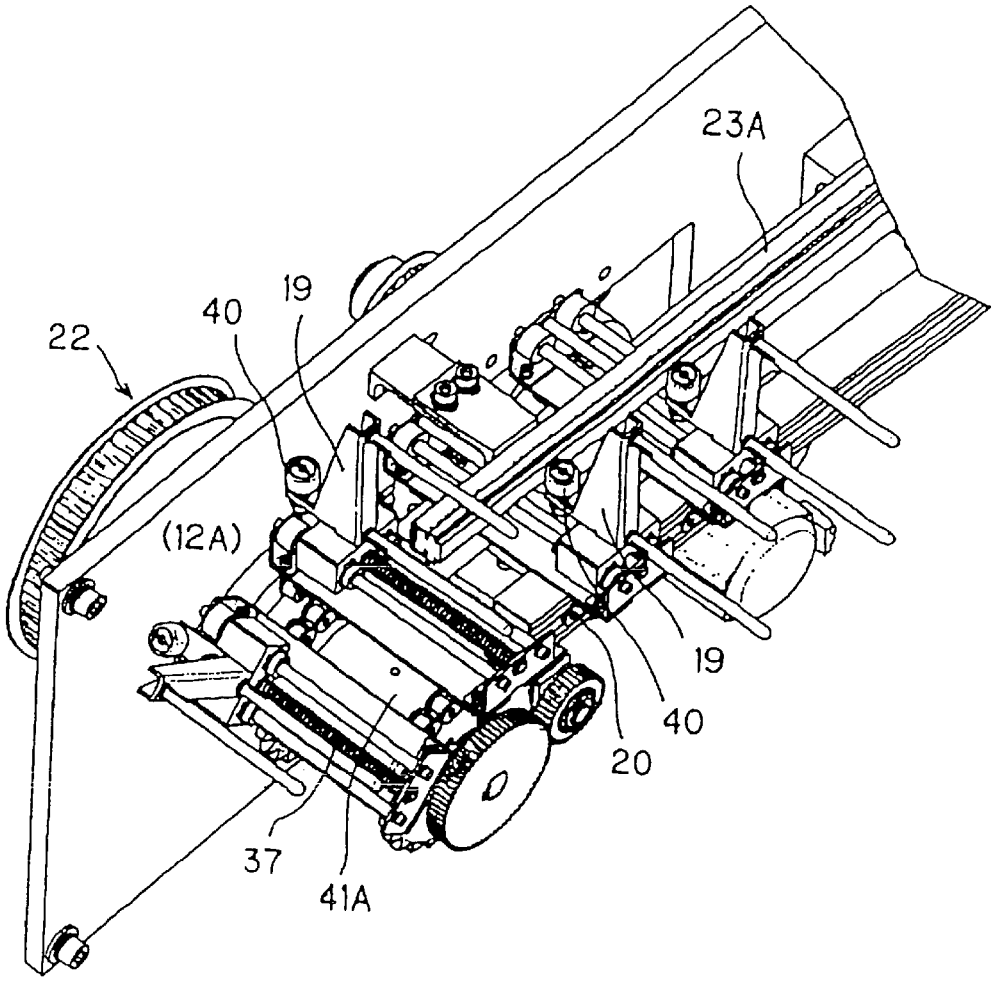
FIG. 16 is an illustration of an operation of the partitioning arm device of the paper-leaves conveying means of the paper-leaves division system according to the embodiment.

When the partitioning arm device 19 confronts the first cam 23A, the roller 40 is brought into contact with the first cam 23A, and the slider 30 is pressed toward the bracket 27*a* against the repulsion of the coil spring 37 as shown in portions of FIGS. 14 and 16 so that the arms 18*a* and 18*b* protrude forwardly a great deal from the back wall 11B. In addition, the arms 18*a* and 18*b* are shifted from the end 12B side to the end 12A side (paper-leaves feeding position 8) in the slits 14*a* and 14*b* in accordance with the rotary motion of the endless chain 21 in the protruding condition. At this time, the paper leaves 10, subdivided between the partitioning arm devices 19 and 19 and supported by the arms 18*a*, 18*b* and the arms 18*a*, 18*b* from both the sides so that a plurality of paper leaves are deposited together in the depositing section 11 in a state stood in a bundle, are shifted toward the paper-leaves feeding position 8, coupled with the conveyance due to the second paper-leaves conveying means 16 and the vibration due to the paper-leaves vibrating means 15, which will be described hereinafter, in a state pressed by the arms 18*a* and 18*b*. Still additionally, when the partitioning arm device 19 is shifted to the paper-leaves feeding position 8 and the roller 40 is separated from the first cam 23A, the slider 30 is instantaneously moved to the bracket 27*b* side by the repulsion of the coil spring 37 in a state guided by the guide bars 28*a* and 28*b* as shown partially in FIGS. 12, 13 and 16. That is, with this movement, the tip portions of the arms 18*a* and 18*b* retreat to a position behind the back wall 11*b*. FIG. 16 illustrates a peripheral structure around the paper-leaves feeding position 8, and shows a state in which that arms 18*a* and 18*b* of the partitioning arm device 19, which are not separated from the first cam 23A, protrude forwardly and the arms 18*a* and 18*b* of the partitioning arm device 19, separated from the first cam 23A, retreat up to the position behind the back wall 11*b*.

Figure 17:
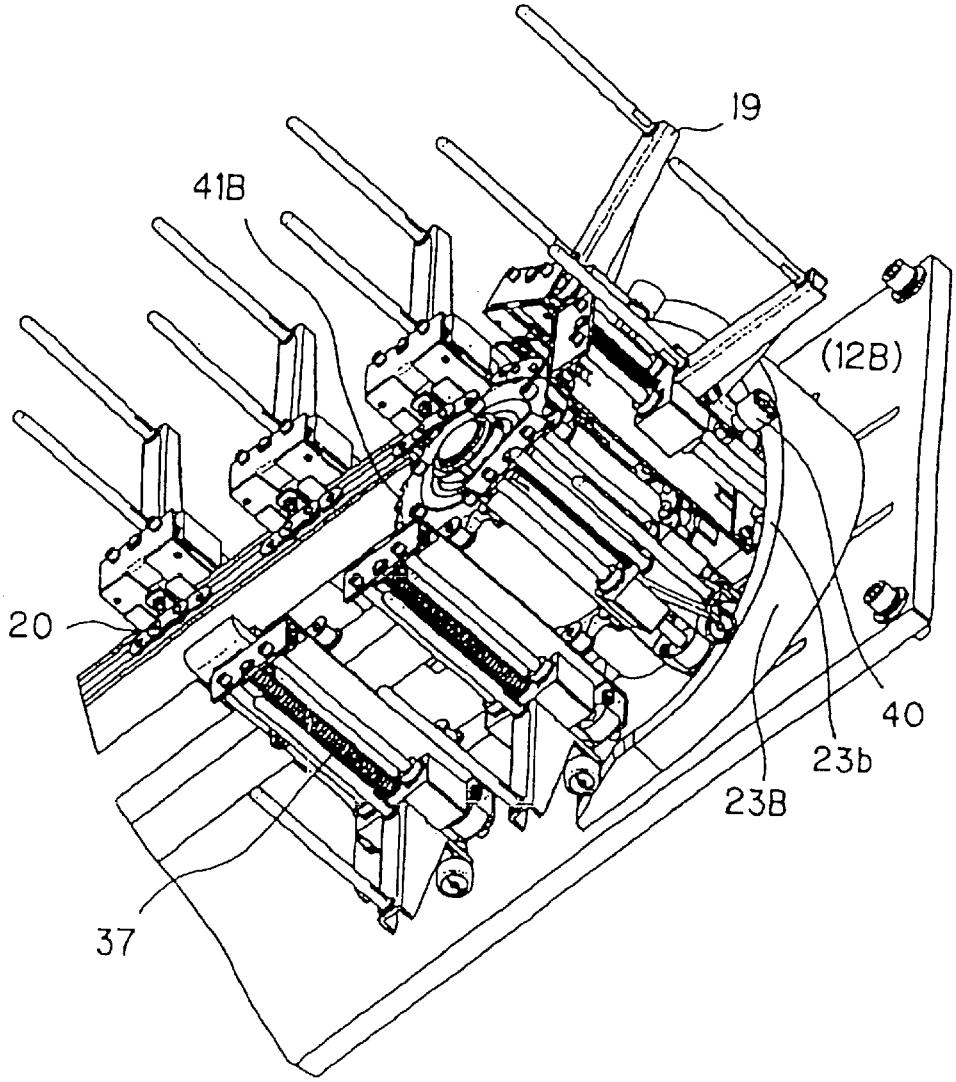
FIG. 17 is an illustration of an operation of the partitioning arm device of the paper-leaves conveying means of the paper-leaves division system according to the embodiment.

Furthermore, at the paper-leaves feeding position 8, the partitioning arm device 19 whose arms 18*a* and 18*b* retreat up to the position behind the back wall 11*b* is shifted up to the other end portion 12*b* through the endless chain 21 in a state where the arms 18*a* and 18*b* are retreated, and the roller 40 is brought into contact with a minimum height portion of an inclined surface 23*b* of the second cam 23B immediately before the other end portion 12B. Moreover, when the roller 40 is moved together with the endless chain 21 in a state brought into contact with the inclined surface 23*b*, the height of that inclined surface 23*b* becomes gradually higher and the cam action of the inclined surface 23*b* causes the slider 30 to be gradually shifted to the bracket 27*a* side while compressing the coil spring 37 so that the arms 18*a* and 18*b* again protrude forwardly a great deal with respect to the back wall 11*b*. FIG. 17 is an illustration of a state in which the arms 18*a* and 18*b* protrude with the roller 40 being brought into contact with the inclined surface 23*b* of the second cam 23B at the other end portion 12B. This protrusion reaches a maximum at a portion adjacent to the first cam 23A, and when arriving at an end of the second cam 23B, they are shifted to the first cam 23A and conveyed toward the paper-leaves feeding position 8 while being again brought into contact with the first cam 23A. Immediately before shifting from the second cam 23B to the first cam 23A, the arms 18*a* and 18*b* again confront the slits 14*a* and 14*b*, and then pass through the slits 14*a* and 14*b* and reach the paper-leaves feeding position 8.

Accordingly, in the construction according to this embodiment, when the roller 40 is moved in a state brought into contact with the first cam 23A, the arms 18*a* and 18*b* are shifted toward the paper-leaves feeding position 8 in a state where they protrude from the back wall 11*b*, and when the partitioning arm device 19 approaches the paper-leaves feeding position 8 and the roller 40 separates from the first cam 23A, the arms 18*a* and 18*b*, together with the slider 30, retreat to the position behind the back wall 11*b*. In addition, the arms 18*a* and 18*b* are moved toward the other end portion 12B in a state of the retreat, and when they approach the other end portion 12B, the roller 40 comes into contact with the second cam 23B. When they are shifted continuously, the same cycle takes place repeatedly, that is, the slider 30, together with the arms 18*a* and 18*b*, is again carried to above the first cam 23A while protruding forwardly. With this operation, the paper leaves 10 placed on the depositing section 11 are successively shifted toward the paper-leaves feeding position 8.

In this construction according to this embodiment, the position of the first cam 23A on the paper-leaves feeding position 8 side is set such that the arms 18*a* and 18*b* support the paper leaves 10 until reaching a position immediately before a position at which the last paper leaf 10 being carried toward the paper-leaves feeding position 8 can lightly touch the separating/supplying belt 67 of the paper-leaves separating/supplying apparatus 9, which will be described later, at the paper-leaves feeding position 8. Concretely, as mentioned above, the arms 18*a* and 18*b* are designed to retreat instantaneously when the paper leaves 10 lightly touch the paper-leaves separating/supplying apparatus 9. With this structure, the last paper leaf is conveyed until lightly touching the belt contact surface 67*a* of the separating/supplying belt 67 of the paper-leaves separating/supplying apparatus 9 at the paper-leaves feeding position 8, thus securing the certain delivery. On the other hand, the paper-leaves conveying means of the conventional apparatus cannot achieve the retreat of the arms immediately before the paper-leaves feeding position. In addition, since the mechanism is made to select the retreating operation, the traveling speed of the retreating arms to the paper-leaves feeding position increases or decreases with respect to the arms traveling behind to lengthen or shorten the arm interval, which can cause the overlap transportation of the paper leaves. Still additionally, the arms themselves cannot retreat instantaneously, but the arms gradually and slowly retreat before arriving at the paper-leaves feeding position. That is, since the arms of the paper-leaves conveying means of the conventional apparatus is not designed to reach a position immediately before the paper-leaves feeding position in a state where they protrude, the operator is required to directly support the paper leaves in order to bring the paper leaves, falling down rearwardly, into contact with a separating/feeding surface (belt contact surface), and this creates a problem on safety and a problem in that difficulty is encountered in performing the work by one person. The construction according to this embodiment, by contrast, is made such that the arms 18*a* and 18*b* protrude until reaching a position immediately a position at which the last paper leaf 10 comes into contact with the belt contact surface 67*a* of the paper-leaves separating/supplying apparatus 9; therefore, it is possible to eliminate the transfer failures that the paper leaves 10 fall down rearwardly before coming into contact with the belt contact surface 67*a*. This can eliminate the need for the stationing of full-time operators who belong exclusively to this operation, which is required in the case of the conventional apparatus, and hence, it is possible to reduce the staff and further to slice the cost. In addition, with the construction according to this embodiment, the position of the first cam 23A on the paper-leaves feeding position 8 side, that is, the position at which the roller 40 of the partitioning arm device 19 is separated from the first cam 23A to allow the arms 18*a* and 18*b* to retreat, is arbitrarily adjustable.

Furthermore, a description will be given hereinbelow of a structure of the paper-leaves vibrating means 15 and a structure of the second paper-leaves conveying means 16.

Figure 18:
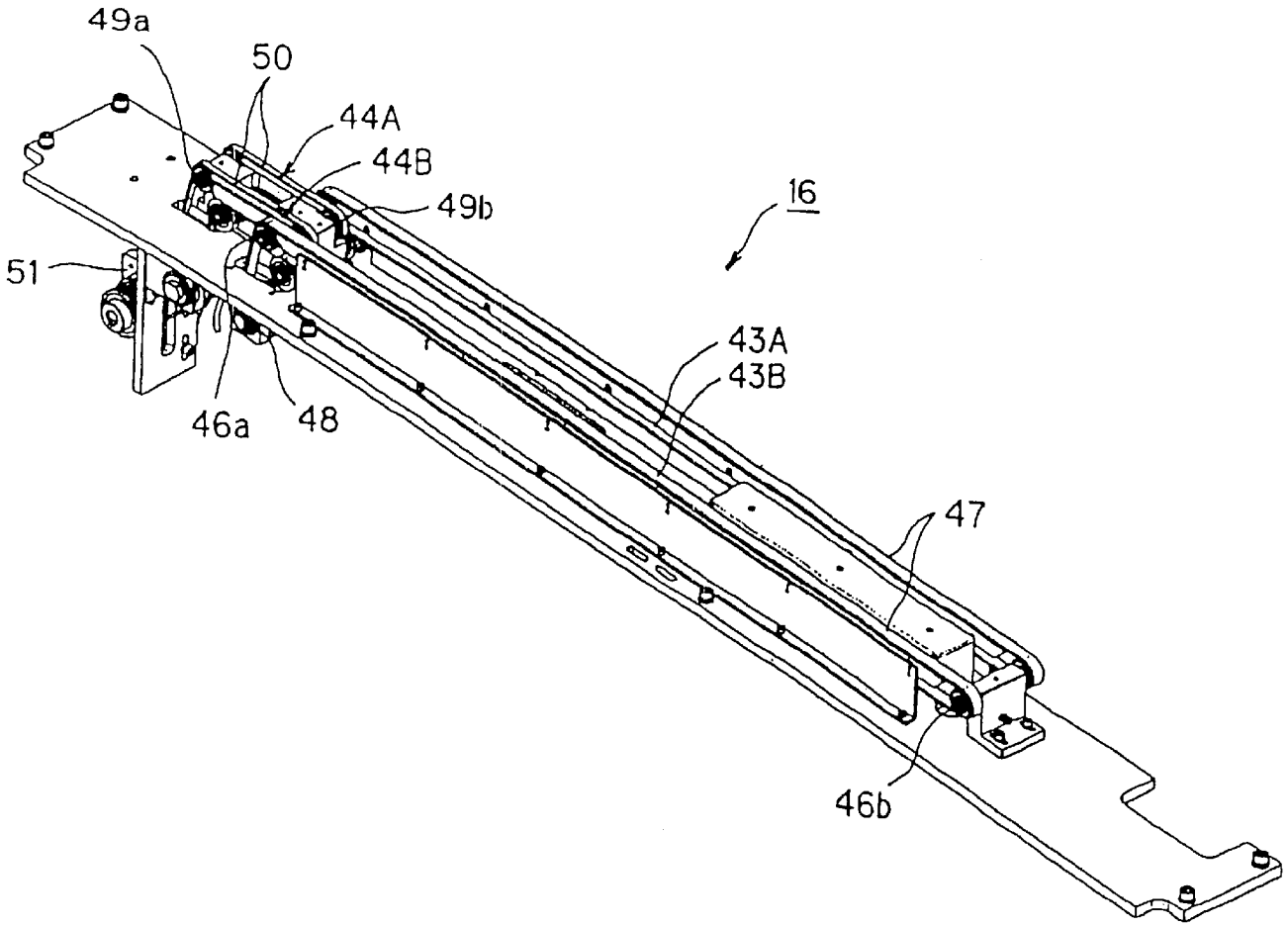
FIG. 18 is a perspective view showing an essential construction of a depositing section of the paper-leaves division system according to the embodiment.

First, the description will start at the structure of the second paper-leaves conveying means 16. FIG. 18 illustrates the details of the structure of the second paper-leaves conveying means 16.

The second paper-leaves conveying means 16 is composed of a pair of conveying belt means 43A and 43B extending in right and left directions in parallel with the endless chain 20 on the back wall 11*b* side, and a pair of auxiliary conveying belt means 44A and 44B extending in right and left directions between the pair of conveying belt means 43A, 43B and the paper-leaves feeding position 8 in a state partially overlapping with the conveying belt means 43A, 43B. The pair of auxiliary conveying belt means 44A and 44B are placed between the conveying belt means 43A and 43B.

Each of the conveying belt means 43A and 43B is composed of a driving pulley 46*a*, an idler pulley 46*b* and an endless belt 47 stretched between the driving pulley 46*a* and the idler pulley 46*b*. The endless belt 47 has a teeth-like configuration, and is disposed so that its upper surface protrudes upwardly from an opening 11*c* (see FIG. 6) of the bottom wall 11*a* of the depositing section 11, and the endless belt 47 directly receives the paper leaves 10 put on the depositing section 11, and the rotary motion of the endless belt 47, together with the conveyance by the paper-leaves conveying means 12, sends the paper leaves 10 toward the paper-leaves feeding position 8. In addition, the driving pulley 46*a* rotates by receiving a driving force of the motor 42, which drives the paper-leaves conveying means 12, through a power conveying belt (not shown), and hence, the second paper-leaves conveying means 16 is operated at a speed synchronized fully with the paper-leaves conveying means 12. In addition, the endless belt 47 and the idler pulley 46*b* are also driven rotationally in accordance with the rotation of the driving pulley 46*a*.

Each of the auxiliary conveying belt means 44A and 44B is composed of a driving pulley 49*a,* an idler pulley 49*b* and an endless belt 50 extending between the driving pulley 49*a* and the idler pulley 49*b*. The surface of the endless belt 50 is made smooth unlike that of the endless belt 47 of the conveying belt means 43A and 43B in order to lessen the frictional force with respect to the paper leaves 10. In addition, the endless belt 50 is disposed so that its upper surface protrudes upwardly from an opening 11*d* (see FIG. 6) of the bottom wall 11*a* of the depositing section 11, and the endless belt 50 directly receives the paper leaves 10 put on the depositing section 11, and the rotary motion of the endless belt 50, together with the conveying by the paper-leaves conveying means 12, transfers the paper leaves 10 toward the paper-leaves feeding position 8. In this case, the endless belt 50 can also be revolved in a direction opposite to the normally feeding direction, that is, in a direction separating from the paper-leaves feeding position 8. The rotary motion of the endless belt 50 depends upon that, when the driving pulley 49*a* is rotationally driven forwardly or backwardly by a driving force of a motor 51 rotatable in two directions of forward and reverse directions, the endless belt 50 and the idler pulley 49*b* are rotationally driven forwardly or backwardly in accordance with the rotation of the driving pulley 49*a*. The traveling speed of the endless belt 50 is the same as that of the paper-leaves conveying means 12 when the paper leaves 10 move toward the paper-leaves feeding position 8, while it is set to be higher, irrespective of the speed of the paper-leaves feeding means 12, when the paper leaves 10 separate from the paper-leaves feeding position 8.

The reason for rotating the auxiliary conveying belt means 44A and 44B in the forward and reverse directions is because, when the paper leaves 10 are conveyed successively into an excessively pressed condition in the area of the paper-leaves feeding position 8, the conveyance by the paper-leaves conveying means 12 and the conveying belt means 43A and 43B is ceased and the endless belt 50 is put in rotary motion in the reverse direction immediately before separation for once returning the paper leaves 10 to relieve the excessively pressed condition of the paper leaves 10 at the paper-leaves feeding position 8. That is, normally, the paper-leaves conveying means 12 and the second paper-leaves conveying means 16 are put in rotary motion at a high speed (a speed higher than that at which the paper-leaves conveying means 12 and the conveying belt means 43A and 43B convey the paper leaves 10) in the same direction (counterclockwise in FIG. 20A) as the direction in which the paper-leaves conveying means 12 and the second paper-leaves conveying means 16 transfer the paper leaves 10, to produce the skidding with respect to the paper leaves 10, and a counterclockwise force is also given to the paper leaves 10 immediately before the paper-leaves feeding position 8 so that the upper edge sides of the paper leaves 10 undergo a falling-down action toward the belt surface 67*a* of the separating/supplying belt 67 immediately before the paper-leaves feeding position 8. Accordingly, the contact of the paper leaves 10 with the separating/supplying belt 67 becomes easy. In addition, when the first paper leaf 10 is pressed too strongly against the separating/supplying belt 67 for some reasons, an over-press sensor 94, which will be mentioned later, detects this fact. If the over-press sensor 94 detects the excessively pressed condition, the motor 51 is driven rotationally in the reserve direction to place the endless belt 50 in rotary motion in the opposite direction (clockwise in FIG. 20B), and when the endless belt 50 is revolved counterclockwise, the endless belt 50 is revolved at a high speed to produce the skidding with respect to the paper leaves 10 so that a counterclockwise force is likewise given to the paper leaves 10 pressed against the separating/supplying belt 67 so that the upper edge sides of the paper leaves 10 undergo a turning and falling-down action in a direction separating from the belt surface 67*a* of the separating/supplying belt 67. Accordingly, the one paper leaf 10 is separated from the paper leaves 10 conveyed up to a position immediately before the separating/supplying belt 67 so that it becomes easy to take by the separating/supplying belt 67, which will be mentioned hereinafter, and to feed toward the downstream side. The reason for forming a smooth surface of the endless belt 50 to relieve the frictional force with respect to the paper leaves 10 is because there is a possibility that a large frictional force damages the lower surfaces of the paper leaves 10 at the peeling-off since the endless belt 50 is placed in rotary motion at a speed higher than a speed, at which the paper-leaves conveying means 12 and the conveying belt means 43A and 43B transfer the paper leaves 10, at all times as mentioned above, whereas the reduction of the friction due to the smooth surface solves this problem. In addition, in a case in which no skidding occurs with respect to the paper leaves 10 because of a large frictional force relative to the paper leaves 10, when the endless belt 50 is placed in rotary motion in the same forward direction as the direction in which the paper-leaves conveying means 12 and the conveying belt means 43A and 43B transfer the paper leaves 10, the lower edge portions of the paper leaves 10 is kicked so that the upper edge portions of the paper leaves 10 are turned in a direction separating from the separating/supplying belt 67 side immediately before the separating/supplying belt 67, while when being turned in the opposite direction, it kicks the lower edge portions of the paper leaves 10 and travels while tripping them, which makes it difficult to separate the upper edge portions a great deal from the separating/supplying belt 67.

Another reason for rotating the auxiliary conveying belt means 44A and 44B in the forward and reverse directions is because the paper leaves deposited in the depositing section 11 in a state tilted rearwardly does not reach a position at which the paper leaves 10 are sufficiently attracted by the belt contact surface 67*a* before being fed while still pressing the an arrival sensor 93 (which will be described herein later) connected to an arrival detecting means 106 and hence the arrival detecting means 106 makes a decision that the paper leaf 10 has arrived at the paper-leaves feeding position 8 and, although the higher-speed feeding operation is to be conducted, the feeding speed becomes lower by being synchronized with the feeding operation of the separating/supplying device 63 to cause the wasteful time which makes it difficult to promptly feed the paper leaves 10, so the paper leaves 10 conveyed up to the paper-leaves feeding position 8 in a rearwardly inclined posture is shifted to the forwardly inclined condition for reducing this wasteful time. In addition, the reason that the surface of the endless belt 50 is made smooth to reduce the frictional force with respect to the paper leaves is because, in a case in which the paper leaves 10 deposited in the depositing section 11 in a rearwardly inclined posture are conveyed up to the paper-leaves feeding position 8 in this posture, there is a need to reverse only the endless belt 50 in a state where stopped are the paper-leaves conveying means 12 and the second paper-leaves conveying means 16. That is, if the belt surface shows a large frictional force or has an irregular or teeth-like configuration, when the endless belt 50 is reversed at a high speed in a state where stopped are the paper-leaves conveying means 12 and the second paper-leaves conveying means 16, the paper leaf 10 retreating from the paper-leaves feeding position 8 is interposed between the paper-leaves conveying means 12, the second paper-leaves conveying means 16 and the endless belt 50 so that only the lower surface of the paper leaf 10 has nowhere to go, which naturally causes the paper leaf 10 to be separated from the belt surface. Although this separation or peeling can damage the lower surface of the paper leaf 10, since the belt surface is made smooth to reduce the friction, it is possible to eliminate the possibility of the damages of the paper leaves.

(A-6) Structure of Paper-Leaves Vibrating Means

Figure 19:
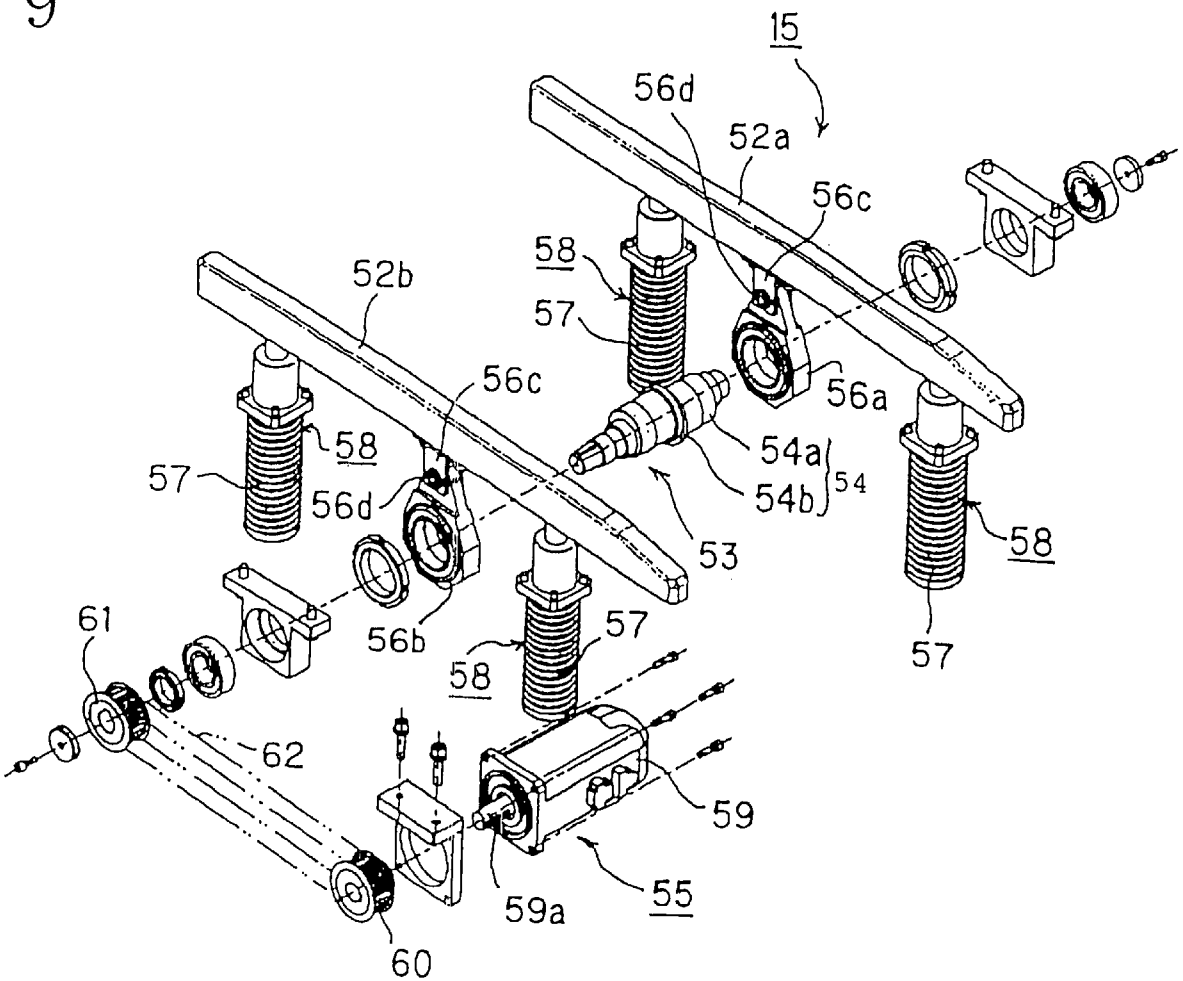
FIG. 19 is an exploded perspective view showing a paper-leaves vibrating device of the paper-leaves division system according to the embodiment.

The paper-leaves vibrating means 15 is, as shown in detail in FIG. 19, composed of elongated vertically-movable members 52*a* and 52*b* extending in right and left directions in parallel with the endless belt 47 between the conveying belt means 43A and 43B, and a vibration generating means 53 for alternately and vertically moving the movable members 52*a* and 52*b*. Each of the movable members 52*a* and 52*b* is made to protrude a great deal from the bottom wall 11*a* through an opening 11*e* (see FIG. 6) made in the bottom wall 11*a* and to retreat therefrom.

The vibration generating means 53 includes a rotary shaft 54 which integrally has eccentric cams 54*a* and 54*b* on its circumferential surface, a driving means 55 for rotating this rotary shaft 54, and cam rings 56*a* and 56*b* acting as a link member for transmitting the cam actions of the eccentric cams 54*a* and 54*b* to the movable members 52*a* and 52*b*. The cam ring 56*a* is rotatably fitted to the eccentric cam 54*a*, while the cam ring 56*b* is rotatably fitted to the eccentric cam 54*b*. In this embodiment, the eccentric cams 54*a* and 54*b* are disposed in a state shifted by 180 degrees from each other in the rotating direction. In addition, the cam rings 56*a* and 56*b* are connected through brackets 56*c* and rotary shafts 56*d* to the central portions of the movable members 52*a* and 52*b*, respectively. When the rotary shaft 54 is put in rotation so that the eccentric cams 54*a* and 54*b* vertically move the cam rings 56*a* and 56*b*, the movable members 52*a* and 52*b* are moved vertically in connection with the cam rings 56*a* and 56*b*. In addition, on both the right and left sides of each of the movable members 52*a* and 52*b*, pulling means 58 are provided each of which has a coil spring 57 for pulling the movable member 52 or 52*b* downwardly at all times.

The driving means 55 includes a motor 59, a pulley 60 attached to an output shaft 59*a* of the motor 59 to be rotatable together, a pulley 61 fitted to the rotary shaft 54 to be rotatable together, and a power transmitting belt 62 set to extend between the pulley 60 and the pulley 61. The rotation of the motor 59 is transferred to the output shaft 59*a*, the pulley 60, the power transmitting belt 62 and the pulley 61 so that the rotary shaft 54 is rotatable together with the pulley 61.

In the paper-leaves vibrating means 15 thus constructed, on the rotation of the rotary shaft 54 by the motor 59, the movable members 52*a* and 52*b* are alternately moved vertically such that the eccentric cams 54*a* and 54*b* pushes up one of the movable members 52*a* and 52*b* through the cam rings 56*a* and 56*b* and pull down the other. That is, one of the movable members 52*a* and 52*b* passes through the opening 11*e* to protrude from the bottom wall 11*a*, while the other movable member 52*a* or 52*b* retreats downwardly with respect to the bottom wall 11*a*. In addition, the entire depositing section 11 is in a state inclined backwardly by approximately 15 degrees, and the self-weight of the paper leaf 10 is divided in the back surface direction and the bottom surface direction, and when the paper leaf 10 is pushed up from the under by the movable member 52*a* or 52*b*, the paper leaf 10 is vibrated in a state turned around the corner forming the intersection of the bottom surface and back surface thereof. Still additionally, since the two movable members 52*a* and 52*b* are disposed in a state separated from each other, they hit against the paper leaf 10 at different positions, and different amplitudes take place for when the front side movable member 52*b* protrudes to vibrate the paper leaf 10 and for when the rear side movable member 52*a* protrudes to vibrate the paper leaf 10, and slight rotating force is given thereto, thus achieving proper arrangement with high efficiency in a short time.

(A-7) Construction of Paper-Leaves Separating/Supplying Apparatus

Figure 20A:
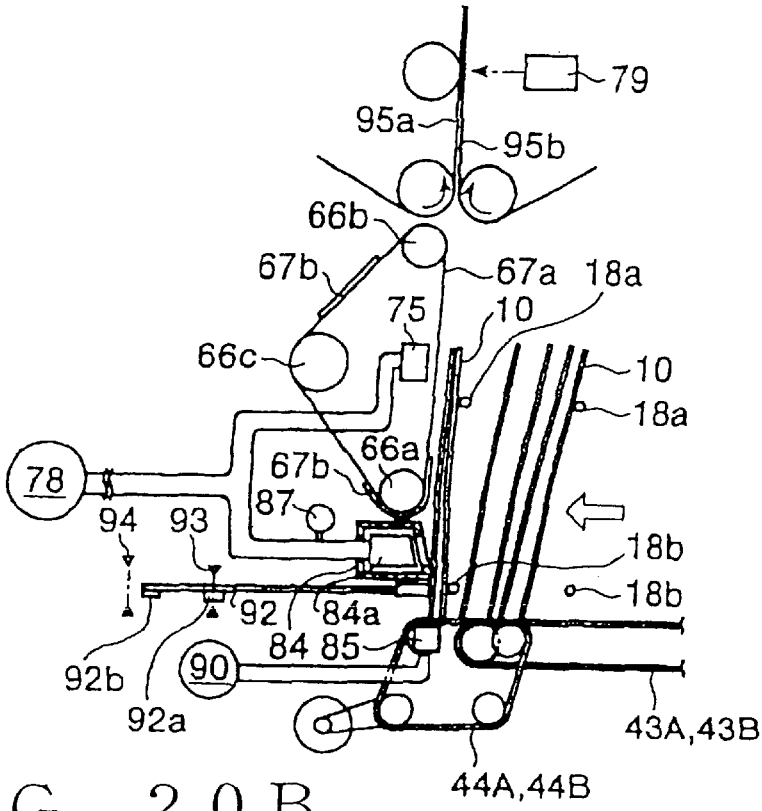
FIGS. 20A and 20B illustratively show a peripheral construction of a paper-leaves separating/supplying apparatus according to the embodiment.
Figure 20B:
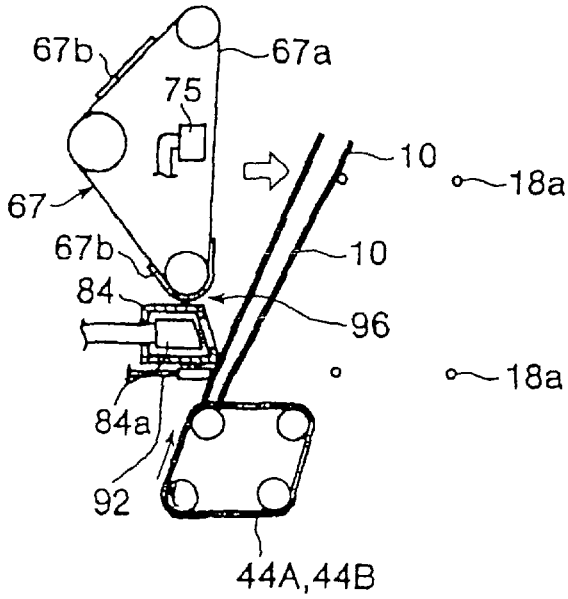
Figure 21:
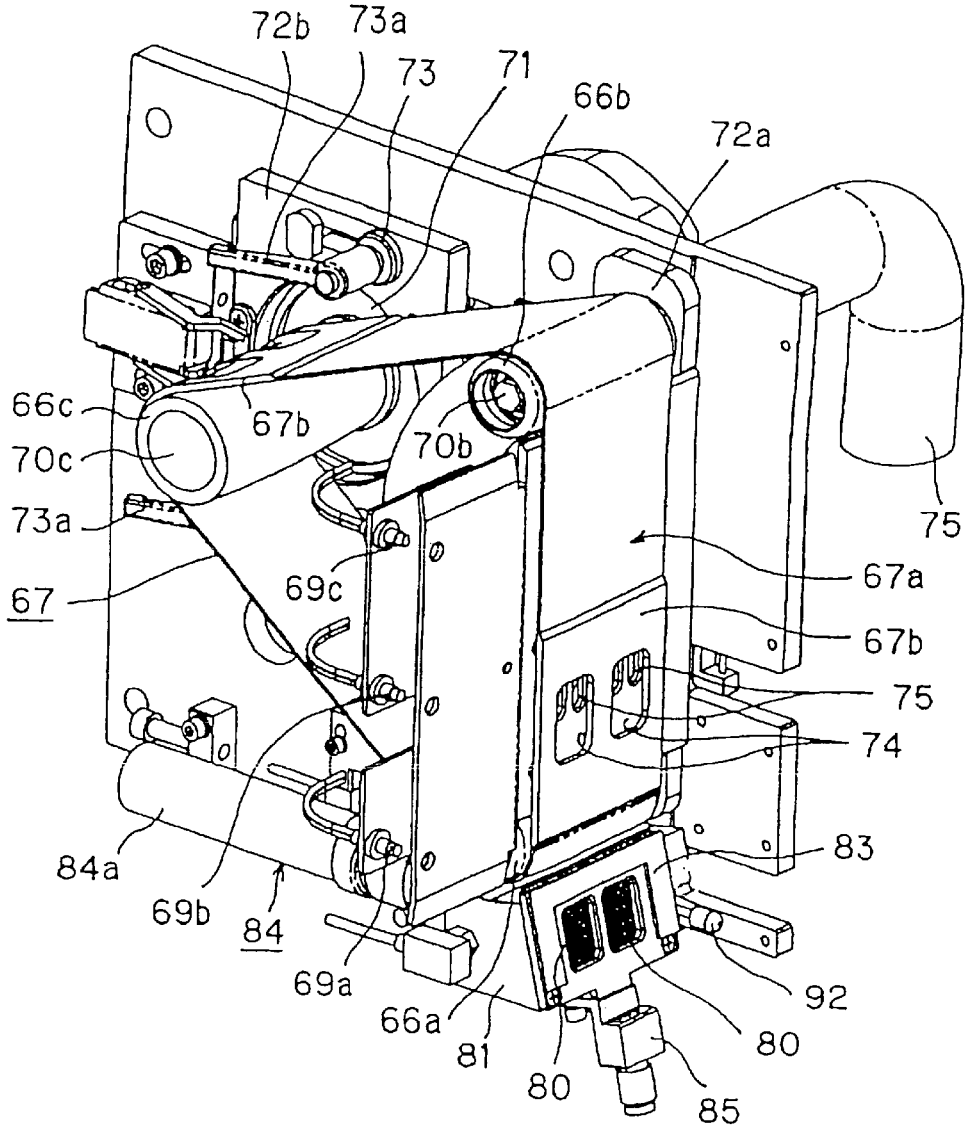
FIG. 21 is a perspective view entirely showing the paper-leaves separating/supplying apparatus according to the embodiment.
Figure 22:
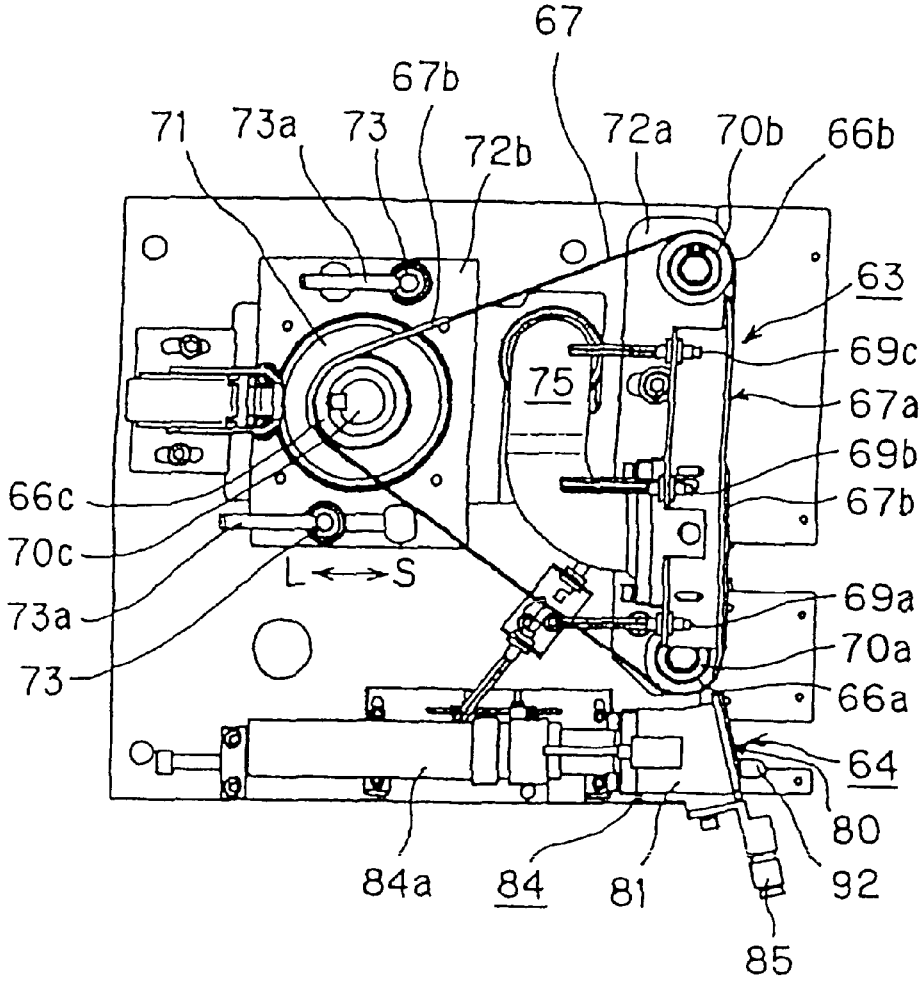
FIG. 22 is a front elevational view showing the paper-leaves separating/supplying apparatus according to the embodiment.
Figure 23:
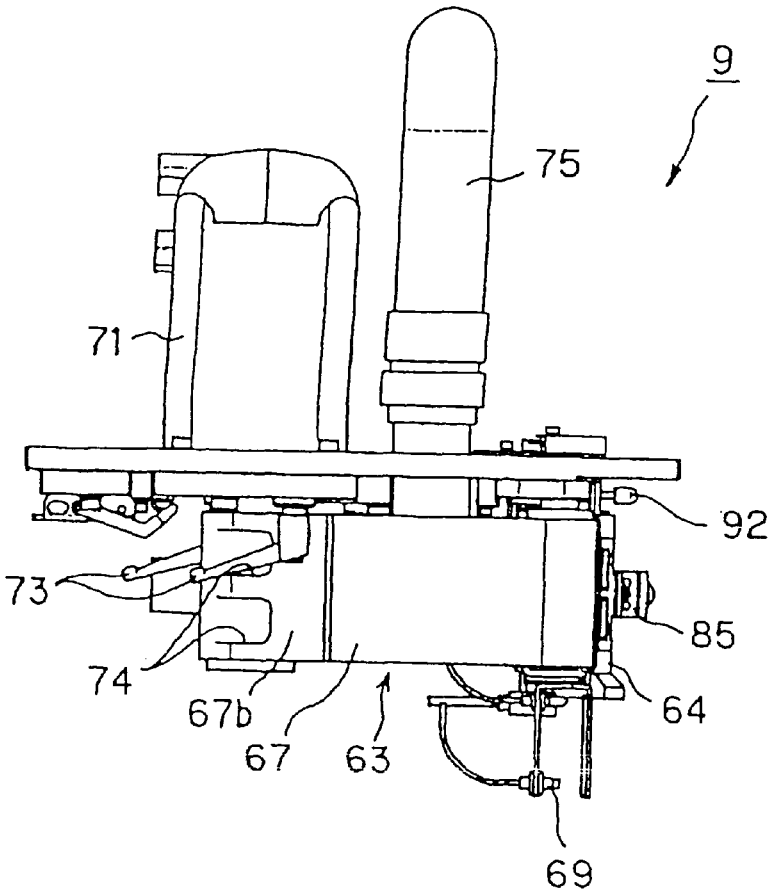
FIG. 23 is a top view showing the paper-leaves separating/supplying apparatus according to the embodiment.

Furthermore, a description will be given hereinbelow of a construction of the paper-leaves separating/supplying apparatus 9 which is for separating the paper leaves 10, conveyed as far as the paper-leaves feeding position 8, from each other and for feeding them toward the paper-leaves conveying means 4. The detail of the construction of the paper-leaves separating/supplying apparatus 9 is shown in FIGS. 5 and 20A to 23. FIG. 5 is a perspective view showing a peripheral structure of the paper-leaves separating/supplying apparatus 9 of the paper-leaves supplying section 1 at the paper-leaves feeding position 8, FIGS. 20A and 20B illustratively show an operation of the peripheral construction of a paper-leaves separating/supplying apparatus 9, FIG. 21 is a perspective view entirely showing the paper-leaves separating/supplying apparatus 9, FIG. 22 is a front elevational view showing the paper-leaves separating/supplying apparatus 9, and FIG. 23 is a top view showing the paper-leaves separating/supplying apparatus 9. In FIGS. 5 and 20A to 23, the paper-leaves separating/supplying apparatus 9 is made up of a separating/supplying device 63 for taking up the paper leaves 10, conveyed to the paper-leaves feeding position 8 in a stand-up condition by the paper-leaves conveying means 12 and the second conveying means 16, one by one by vacuum suction and for conveying the paper leaf 10 in a generally perpendicular condition to the paper-leaves conveying means 4 existing on the downstream side, a separation auxiliary device 64 for facilitating the separation of the paper leaves 10 from each other in the separating/supplying device 63, a paper-leaves detecting means (which is an abbreviation of paper-leaves arrival detecting means) 106 (see FIG. 28) for detecting the presence or absence of the paper leaf 10 conveyed to the paper-leaves feeding position 8, and a paper-leaves excessive-pressing detecting means 105 (see FIG. 28).

(A-8) Structure of Separating/Supplying Device

The separating/supplying device 63 is composed of an endless separating/supplying belt 67 stretched around three guide rollers 66*a*, 66*b* and 66*c*, a vacuum suction means 68 for vacuum-catching the paper leaves 10, transferred up to this separating/supplying belt 67, to hold them on the separating/supplying belt 67, and three sensors 69*a*, 69*b* and

Figure 28:
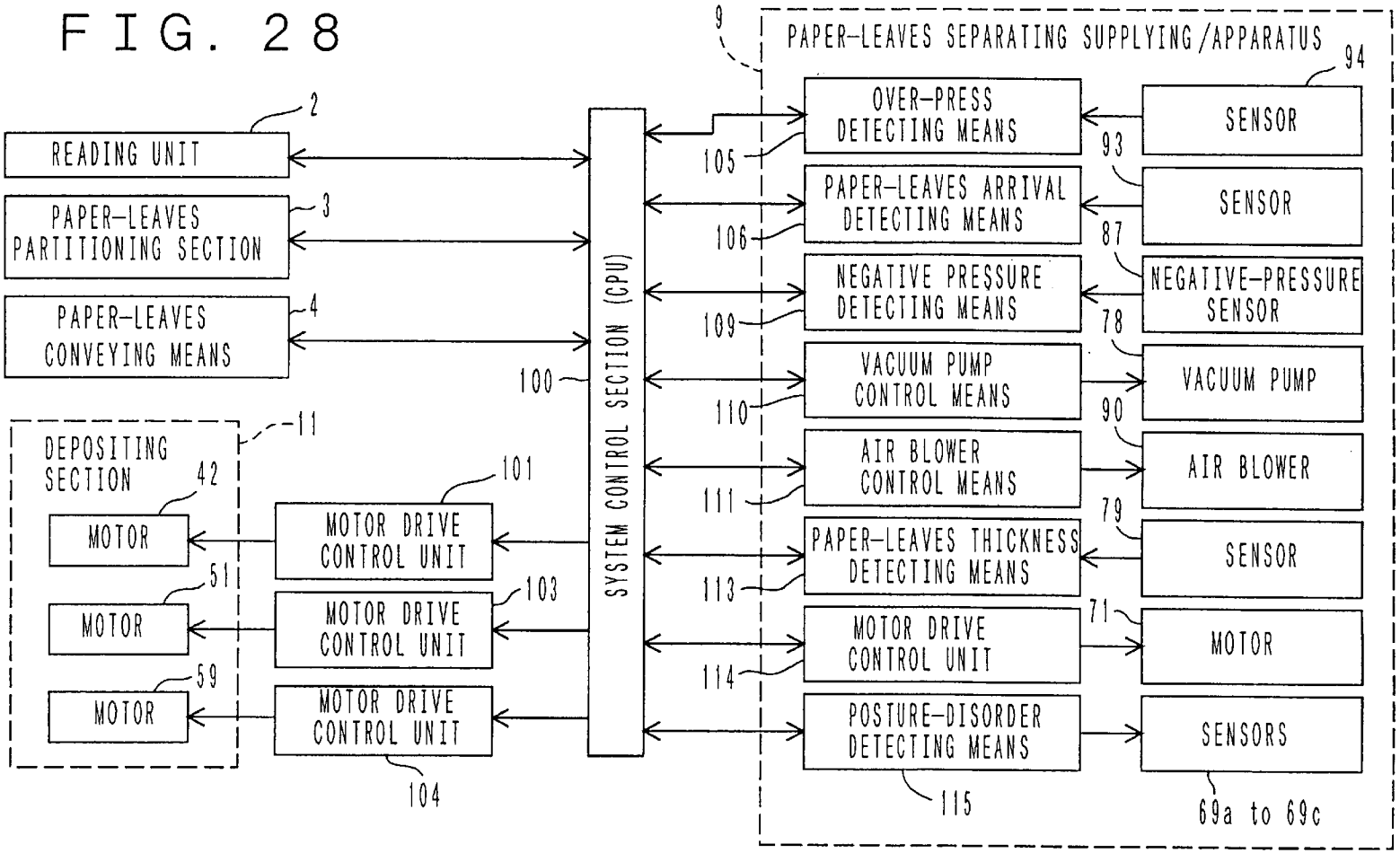
FIG. 28 is a block diagram showing of the entire circuit arrangement of a paper-leaves conveying apparatus of the paper-leaves division system according to the embodiment.

69*c* for detecting the size of the paper leaves 10 transferred to the separating/supplying device 63, and the presence of paper leaves 10 transferred in a state put in posture disorder or placed in misarrangement, and for sending output information to a posture-disorder detecting means 115 (see FIG. 28).

Of the three guide rollers 66*a*, 66*b* and 66*c*, the two guide rollers 66*a* and 66*b* are disposed in a state separated vertically along a direction of feeding the paper leaves 10, while the remaining one guide roller 66*c* is located therebehind. Accordingly, a portion 67*a* (which will be referred to hereinafter as a "belt contact surface 67*a*") of the separating/supplying belt 67 stretched by the three guide rollers 66*a*, 66*b* and 66*c*, confronting the paper-leaves feeding position 8, is made to have a flat plane (perpendicular plane), thus straight traveling vertically. In addition, the guide rollers 66*a* and 66*b* are idler rollers rotatably attached to rotary shafts 70*a* and 70*b*, respectively, while the guide roller 66*c* is a driving roller fitted to a driving shaft 70*c*, rotated by a motor 71, to be rotatable together. When the driving shaft 70*c*, together with the guide roller 66*c*, is rotated by the motor 71, the separating/supplying belt 67, together with the guide roller 66*c*, is revolved in accordance with the rotation of the guide rollers 66*a* and 66*b*. The rotating direction thereof is the counterclockwise direction in FIGS. 5 and 20A to 23.

In addition, the driving shaft 70*c* is mounted on a movable holding plate 72*b* unlike a fixed holding plate 72*a* to which attached are the rotary shafts 70*a* and 70*b* for supporting the guide rollers 66*a* and 66*b*. This movable holding plate 72*b*, together with the motor 71 and the driving shaft 70*c*, is made to be movable in a direction approaching the guide rollers 66*a* and 66*b*, indicated by an arrow S in FIG. 22 (direction to the interior of the separating/supplying belt 67) and in a direction of separating therefrom, indicated by an arrow L in FIG. 22. When it is moved in the separating direction indicated at the arrow L, the separating/supplying belt 67 around the guide rollers 66*a*, 66*b* and 66*c* is tightened, and when being moved in the approaching direction indicated at the arrow S, the separating/supplying belt 67 loses the tightness. In addition, the position of the movable holding plate 72*c* can be fixed, but releasable, by a locking means 73 having a locking lever 73*a*. Accordingly, with the structure of the separating/supplying device 63 according to this embodiment, when the movable holding plate 72*b* is released from the locked state by the locking means 73 and the guide roller 66*c*, together with the movable holding plate 72*b*, is shifted in the inside direction of the separating/supplying belt 67 so that the separating/supplying belt 67 loses the tightness, the replacement of the separating/supplying belt 67 or the like becomes possible in this state. After the replacement, the guide roller 66*c*, together with the movable holding plate 72*c*, is returned to the original position and locked there. Thus, it is possible to easily accomplish the replacement of the separating/supplying belt 67 or the like.

In the case of a conventional separating/supplying belt, in order to achieve certain separating/supplying operations, there is a need for the outer circumferential surface of the belt to have irregularities. Therefore, there may be a problem in that, in a case in which a tension roller is provided in the exterior of the belt to produce the inward tension, the irregularities on the outer circumferential surface of the belt can damage the tension roller. In addition, there has been known an auto-tension mechanism in which the tension roller is made to be movable and a spring is put to use. However, in this case, a continuous load acts on the spring itself so that the spring can be broken. Still additionally, in the case of a conventional belt replacement method, after the replacement, a belt tension depends on operator's sensation, and hence, a value is hard to set uniformly, or this requires a special tool. On the other hand, with the construction according to this embodiment, the movable holding plate 72*b* is released from the locked state by the locking means 73, and the guide roller 66*c*, together with the movable holding plate 72*b*, is shifted to the inside of the separating/supplying belt 67 so that the separating/supplying belt 67 loses the tightness, which enables easy replacement of the separating/supplying belt 67 and others. In addition, after the replacement, since the guide roller 66*c*, together with the movable holding plate 72*b*, can be returned to the original state and locked there, it is possible to easily accomplish the replacement of the separating/supplying belt 67, and others.

Furthermore, in the construction according to this embodiment, the guide rollers 66*a* and 66*b* forming the belt contact surface 67*a* pointing in the direction of conveying the paper leaves 10 are designed to take a fixed state after performing positional adjustment, which will be described later, in cooperation with the fixed holding plate 72. That is, since the guide rollers 66*a* and 66*b* is designed not to move at the belt replacement, the location of the belt contact surface 67*a* does not shift even at the belt replacement. If the belt contact surface 67*a* shifts at the paper-leaves feeding position 8, three is a need to again adjust the positional relationship between the aforesaid arms 18*a* and 18*b* of the paper-leaves conveying means 12 and the belt contact surface 67*a*, which causes the operation to become complicated. In the construction according to this embodiment, the position of the belt contact surface 67*a* does not shift at the belt replacement; therefore, it is maintainable at the same position and in the same state. In addition, the guide roller 66*c* is designed to be moved together with the motor 71, the driving shaft 70*c* and the movable holding plate 52*c*, and irrespective of the movement of the guide roller 66*c*, the positional relationship with the motor 71 and the driving shaft 70*c* is securable at all times, which eliminates the need for re-adjusting (or re-assembling) the positional relationship with respect to the motor 71 and the driving shaft 70*c* after the replacement.

Moreover, the separating/supplying belt 67 is disposed so that the belt contact surface 67*a* is placed at right angles to the horizontal plane (bottom wall 11*a*) or placed in a state slightly (θ1) inclined toward the depositing section 11 side. The angular adjustment of the belt contact surface 67*a* can arbitrarily be made with respect to the bottom surface 11*a* by rotating the fixed holding plate 72*a*, which holds the guide roller 66*a* and 66*b* to allow them to be rotatable, clockwise or counterclockwise in FIG. 22. Usually, this angular adjustment is made once at manufacturing and assembling, and thereafter, it is placed in a fixed condition. In the construction according to this embodiment, the reason that the belt contact surface 67*a* is placed at right angles to the bottom wall 11*a* or placed in a state inclined toward the depositing section 11 side is to eliminate the contact pressure between the preceding paper leaf 10 and the succeeding paper leaf 10 which occurs when, subsequent to the preceding paper leaf brought into contact with the belt contact surface 67*a* of the separating/supplying belt 67, the succeeding paper leaf 10 come and the weight (self-weight) of the succeeding paper leaf 10 falls on the preceding paper leaf 10. That is, in a case in which the preceding paper leaf 10 is held prependicularly or in a state inclined at the belt contact surface 67*a*, it is possible to prevent the weight of the succeeding paper leaf from being applied to the preceding paper leaf 10. Accordingly, since the construction of the separating/ supplying device 63 according to this embodiment can eliminate the external force which is a large contact pressure between the preceding paper leaf 10 and the succeeding paper leaf 10 occurring when the weight of the succeeding paper leaf 10 falls on the preceding paper leaf, the separating/supplying belt 67 can smoothly feed the preceding paper leaf 10. In addition, it is possible to prevent the succeeding paper leaf 10 from being put in disorder because of being dragged by the preceding paper leaf 10, and when the succeeding paper leaf 10 is fed subsequently, the succeeding paper leaf 10 is preventable from being fed in an unstable posture. This secures smooth feeding of the paper leaf 10 without the occurrence of troubles. Incidentally, two paper-leaves suction-holding members 67*b* each having a pair of suction windows 74 for attracting the paper leaves 10 by vacuum suction are placed on the separating/supplying belt 67 in a state disposed separately by 180 degrees, with no air communication being made at portions other than the suction windows 74.

The vacuum suction means 68 of the separating/supplying device 63 has suction ducts 75 placed behind the belt contact surface 67*a* in the interior of the separating/supplying belt 67, with the suction ducks 75 being connected to a vacuum pump 78. In addition, the suction ducts 75 are placed to confront the suction windows 74 of the paper-leaves suction-holding members 67*b* of the separating/supplying belt 67, and an intake opening is covered with the separating/supplying belt 67 when the separating/supplying belt 67 is placed in rotary motion so that the suction windows 74 disappear in front of the suction ducts 75, and when the suction windows 74 arrive in front of the suction ducts 75, the intake opening is opened so that air comes in the suction ducts 75 due to the suction force from the vacuum pump 78. At this time, the paper leaf 10 transferred to a position adjacent to the paper-leaves suction-holding member 67*b* is taken up in a state adhering onto a surface of the paper-leaves suction-holding member 67*b* to again cover the intake opening, and is transferred by the separating/supplying belt 67 in an upward direction, that is, it is transferred vertically toward the paper-leaves conveying means 4. The suction duct 75 has an elongated configuration in the traveling direction of the separating/supplying belt 67, and the paper leaf 10, being transferred upwardly with the separating/supplying belt 67 in a state attracted through the suction windows 74, is carried until it is held between conveying belts 95*a* and 95*b* of the paper-leaves conveying means 4. In addition, the separating/supplying belt 67 is not placed in rotary motion at all times, but commonly stands by at the home position where the paper-leaves suction-holding member 67*b* is separated from the front surface of the suction duct 75, and it covers the front surface of the intake opening of the suction duct 75. When a sensor (arrival sensor) 93 detects that the paper leaf 10 arrives at the paper-leaves feeding position 8, the motor 71 is rotated to revolve the separating/supplying belt 67, and when this separating/supplying belt 67 is revolved 180 degrees to reach the home position, the rotation of the motor 71 stops to cease the separating/supplying belt 67. In addition, while the separating/supplying belt 67 makes 180-degree revolution, the suction windows 74 once pass by the suction ducts 75, thus performing the feeding of the paper leaves 10 once. That is, one paper leaf 10 is fed according to 180-degree movement. Incidentally, in this embodiment, although two paper-laves suction-holding members 67*b* are provided on the separating/supplying belt 67 at an interval of 180 degrees, in the case of the use of one paper-leaves suction-holding member 67*b*, one paper leaf 10 is fed according to 360-degree revolution. Moreover, depending on the dimension of the separating/supplying belt 67, it is also possible to use three or more paper-leaves suction-holding members 67*b*.

Figure 27:
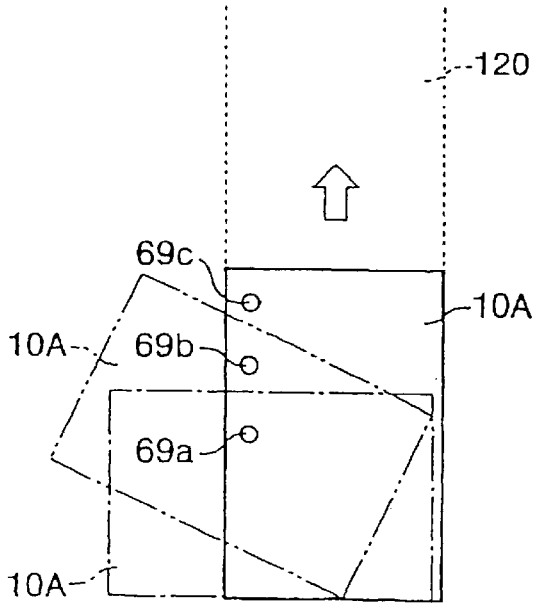
FIG. 27 is an illustration useful for explaining an unacceptable posture detecting operation of the paper-leaves division system according to the embodiment.

The three sensors 69*a*, 69*b* and 69*c* for the posture-disorder detecting means 115 is of a reflection type, and as illustratively shown in FIG. 27, they are disposed to be scattered along the conveying direction in the substantially maximum width portion of a conveyance area 120 into which the paper leave 10A available in this paper-leaves division apparatus is normally fed in a state attracted by the separating/supplying belt 67. The posture-disorder detecting means 115 using these sensors 69*a* to 69*c* makes a decision that the paper leaf 10A is in a properly positioned condition, indicated by a solid line in FIG. 27, when the three sensors 69*a* to 69*c* detect it simultaneously. On the other hand, the posture-disorder detecting means 115 makes a decision that the paper leaf 10A is in a posture-disorder condition because of being pushed down or titled, as indicated by a dashed line or two-dot chain line in FIG. 27, when only one sensor 69*a* of the three sensors 69*a* to 69*c* detects it (the paper leaf 10A indicated by the dashed line) or when only two sensors 69*a* and 69*b* detect it (the paper leaf 10A indicated by the two-dot chain line). At this time, the output information from the posture-disorder detecting means 115 is forwarded to a system control section 100 (FIG. 28) which will be described later, and the system control section 100 issues alarm or the like and, at the same time, stops the apparatus, thus informing the operator of this trouble. Accordingly, it is possible to prevent the paper leaves 10 from being fed in a posture-disordered condition from the separating/supplying device 63.

The separation auxiliary device 64 is positioned under the separating/supplying device 63, and includes a housing 81 having an auxiliary suction window 80 (which will be referred to hereinafter as an "auxiliary contact surface 80") serving as an auxiliary contact surface open to a direction in which the paper leaves 10 are conveyed by the paper-leaves conveying means 12, and an intake opening of a suction duct 84*a* acting as an auxiliary vacuum suction means 84 is made in the housing 81. The suction duct 84*a* uses, as a suction source, the vacuum pump 78 as well as the suction ducts 75 of the vacuum suction means 68, and the suction passage from the vacuum pump 78 is halfway branched into an intake passage extending to the suction duct 75 side and an intake passage extending to the suction duct 84*a* side. A negative-pressure sensor 87 is provided in the suction duct 84*a* to measure a negative pressure in the interior of the suction duct 84*a*. In addition, in the relationship between the intake area of the suction duct 84*a* in the auxiliary suction means 84 and the intake area of the suction duct 75 in the vacuum suction means 68, the intake area of the suction duct 84*a* in the auxiliary suction means 84 is set to be larger than the intake area of the suction duct 75 in the vacuum suction means 68. Still additionally, the auxiliary contact surface 80 is not arranged in a linear relation to the belt contact surface 67*a* of the separating/supplying belt 67, but the lower side thereof somewhat protrudes toward the depositing section 11 side, and the contact surface 67*a* and the auxiliary contact surface 80 are disposed in a generally doglegged condition. Moreover, as shown in detail in FIGS. 24 to 26, a net 82 with an air permeability is placed in front of the auxiliary contact surface 80 to cover the front surface thereof, and a U-shaped frame 83 is placed outside. This frame 83 forms an irregular portion outside the auxiliary contact surface 80, and the frame 83 makes a convexity while the internal area surrounded by the frame 83 makes a concavity. The lower end portion of the frame 83 is set not to reach a lower portion 83*a* of the auxiliary contact surface 80.

Figure 24:
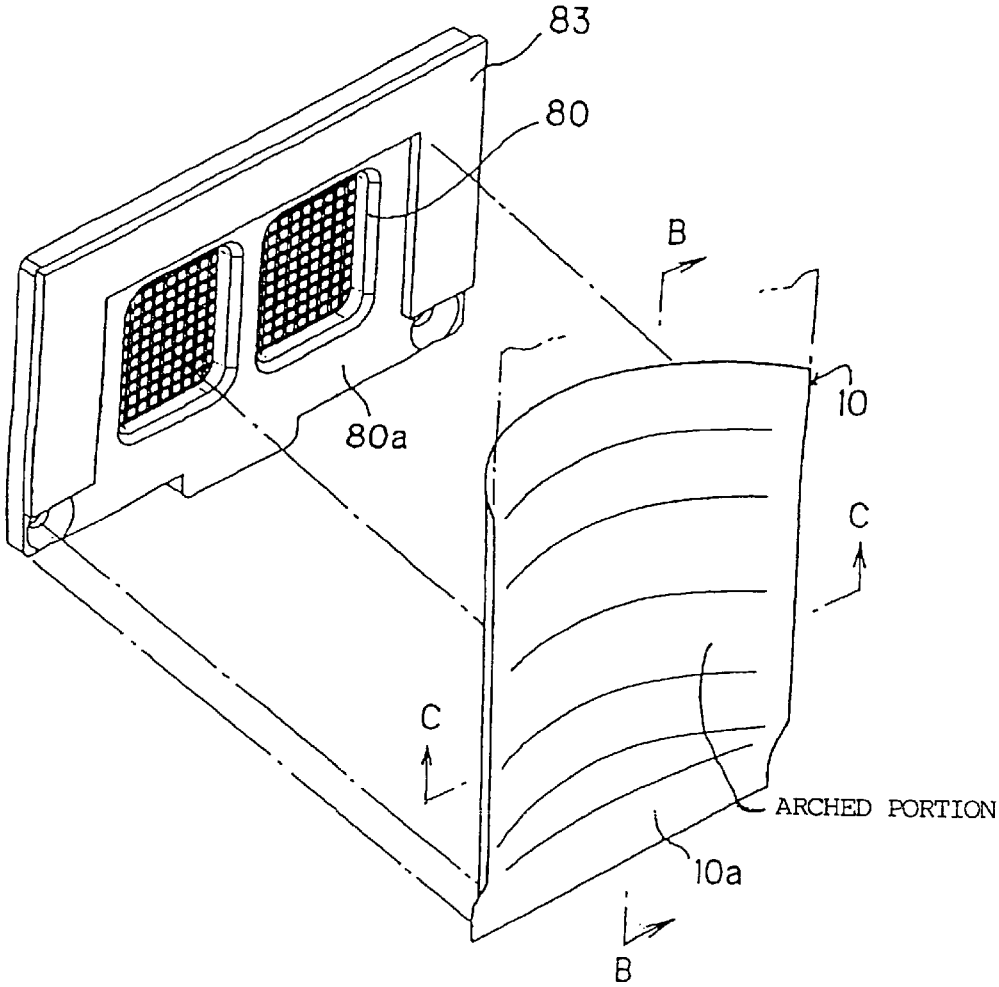
FIG. 24 is a perspective view showing an essential construction of a separation auxiliary device of the paper-leaves division system according to the embodiment.
Figure 25:
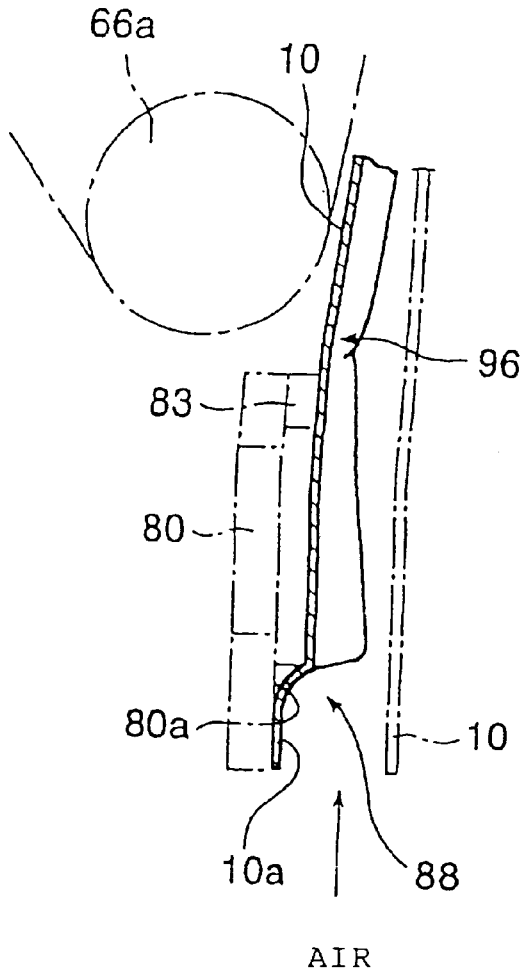
FIG. 25 is a cross-sectional view taken along an arrow line B—B of FIG. 24.
Figure 26:
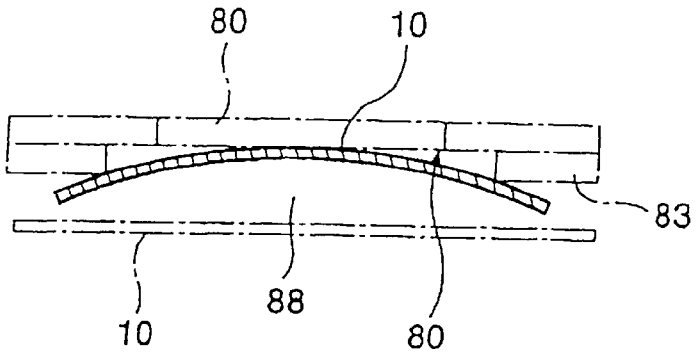
FIG. 26 is a cross-sectional view taken along an arrow line C—C of FIG. 24.
Figure 30:
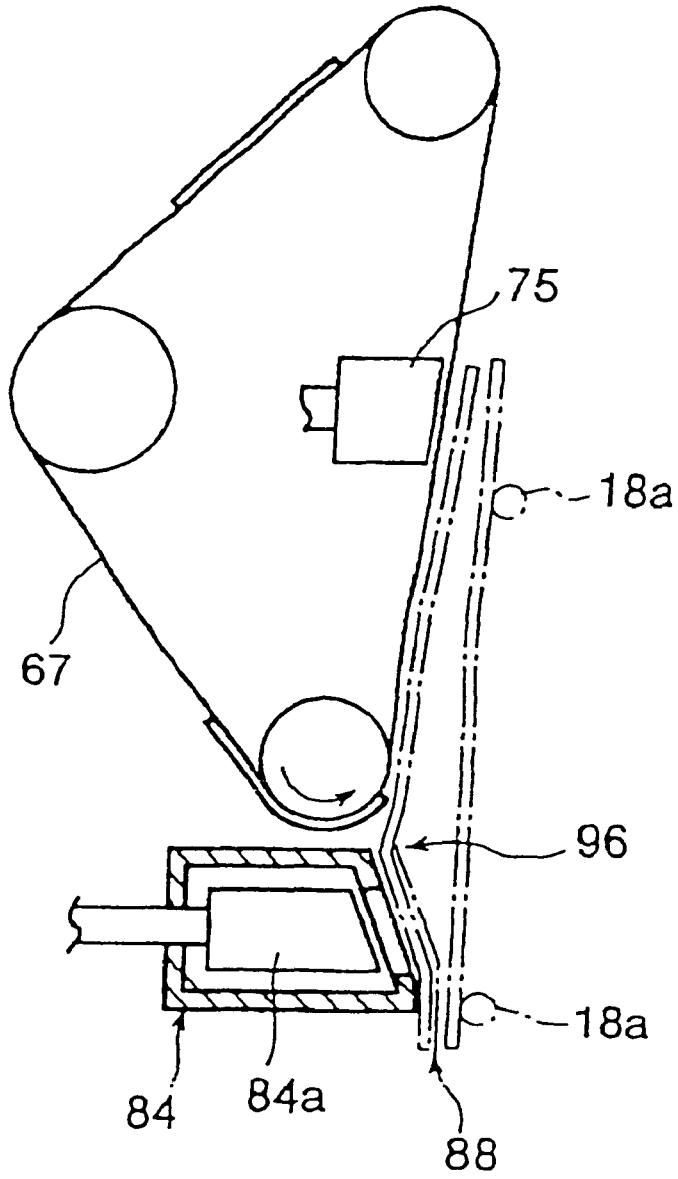
FIG. 30 is an illustrative view showing an essential construction of a paper-leaves separating/supplying apparatus according to the embodiment.

When the paper leaf 10 arrives at the paper-leaves feeding position 8, a lower end portion of the paper leaf 10 is vacuum-sucked by the suction duct 84*a* and is attracted to adhere onto the auxiliary contact surface 80, which covers the intake opening of the suction duct 84*a*. Due to this attraction, the lower end portion thereof is bent as shown in FIGS. 24 to 26. FIG. 24 is an exploded perspective view showing an essential construction, and showing a state in which a lower end portion of the paper leaf 10 is attracted by the auxiliary contact surface 80, FIG. 25 is a cross-sectional view taken along an arrow line B—B of FIG. 24, and FIG. 26 is a cross-sectional view taken along an arrow line C—C of FIG. 24. In FIGS. 24 to 26, since the frame 83 forms convex portions at the both end portions and upper portion of the auxiliary contact surface 80, the central portion of the paper leaf 10 protrudes to the auxiliary contact surface 80 side and both the end portions of the paper leaf 10 protrude to the succeeding paper leaves 10 side, which forms a horizontal cross-section bent into a generally arch-like configuration to produce a warp. In this case, since the frame 83 is not placed at a lower end portion 80*a* of the auxiliary surface 80 to form a plane, the lowermost portion of the paper leaf 10 forms a flat portion 10*a*. If the flat portion 10*a* is made under the arched portion, a gap 88 established with respect to the succeeding paper leaf 10 is prolonged, and air for peeling, which will be described later, is given to this gap 88. Accordingly, in the structure of the auxiliary contact surface 80 thus made, when the lower end portion of the paper leaf 10 conveyed to the paper-leaves feeding position 8 is suction-adhered to the auxiliary contact surface 80 to be warped, even if the succeeding paper leaf 10 is conveyed in an overlapping condition, the warping produces a flipping effect for the peeling and forms the gap 88 (see FIGS. 25 and 26) with respect to the succeeding paper leaf 10, thus preventing the adhesion between the preceding paper leaf 10 and the succeeding paper leaf 10. At the same time, since, at a portion 96 (see FIGS. 26 and 30) between the auxiliary contact surface 80 and the belt contact surface 67 of the separating/supplying belt 67, an angle is made to form a doglegged configuration, the paper leaf 10 suction-adhered to the auxiliary contact surface 80 is bent between the auxiliary contact surface 80 and the belt contact surface 67, and as illustratively shown in FIGS. 25 and 30, this bent portion 96 also defines a gap with respect to the succeeding paper leaf 10.

In addition, a blast duct 85 associated with the gap 88 is located under the gap 88 portion to jet air toward the gap 88. The air from the blast duct 85 strikes on the gap 88 from the under to positively make the separation between the paper leaves 10 and 10 so that the first paper leaf 10 is held and transferred by the separating/supplying belt 67. Still additionally, since the aforesaid flat configuration is made at the lower end portion of the paper leaf 10 brought into contact with the auxiliary contact surface 80 to secure a large opening for accommodating air, the gap 88 can accept a large amount of air from the blast duct 85, thus efficiently achieving the peeling of the succeeding paper leaf 10. The blast duct 85 is connected through a valve 89 to an air blower 90.

The paper-leaves detecting means 106 and the paper-leaves over-press detecting means 105 are located under the separation auxiliary device 64. A contact 92 is placed to extend to the interior of the depositing section 11 in the paper-leaves conveying direction, and a paper-leaves sensor 93 for the paper-leaves detecting means 106 and an over-press sensor 94 for the paper-leaves over-press detecting means 105 are placed behind the contact 92. In addition, a shade 92*a* for the paper-leaves sensor 93 and a shade 92*b* for the over-press sensor 94 are placed in a part of the contact 92. When the paper leaf 10 is absent at the paper-leaves feeding position 8, the contact 92 protrudes a great deal to the interior of the depositing section 11, and each of the shades 92*a* and 92*b* is positioned at a position separated from each of the paper-leaves sensor 93 and the over-press sensor 94. When the paper leaf 10 is conveyed to the paper-leaves feeding position 8 by means of the paper-leaves conveying means 12 and the second paper-leaves conveying means 16 and the contact 92 is pressed by that paper leaf 10 to retreat, and the shade 92*a* is first put in the interior of the paper-leaves sensor 93 so that the paper-leaves sensor 93 detects that the paper leaf 10 arrives at the paper-leaves feeding position 8. The paper-leaves sensor 93 forwards a detection signal to the paper-leaves detecting means 106 (see FIG. 28), thereby detecting the presence or absence of the paper leaf 10. In addition, when the paper leaf 10 is transferred in a proper condition without being excessively pressed to the separating/supplying belt 67 side, the contact 92 is maintained in that state without further retreating. On the other hand, if the paper leaves 10 are conveyed successively in an overlapped condition and then stopped up, the contact 92 further retreats and the shade 92*a* advances to the interior of the over-press sensor 94 and, hence, the over-press sensor 94 detects the fact that the paper leaf 10 is in an excessively pressed condition, and sends a detection signal to the over-press detecting means 105 (see FIG. 28). Thus, the over-press detecting means 105 detects the over-press condition.

(A-9) Construction of Paper-Leaves Conveying Means Side

The paper-leaves conveying means 4 includes a driving system side conveying belt means 95*a* and an idler system side conveying belt means 95*b* placed to be adjacent to the belt contact surface 67*a* of the separating/supplying belt 67 and to be in opposed relation to each other. This paper-leaves conveying means 4 is made such that the paper leaves 10 fed vertically by the separating/supplying belt 67 are led to between the driving system side conveying belt means 95*a* and the idler system side conveying belt means 95*b* to be carried through the reading unit 2 to the partitioning/stacking units 3*a* side.

In addition, inside the conveying belt means 95*b*, there is provided a thickness sensor 70 for the paper-leaves thickness detecting means 113 (see FIG. 28), which is for detecting the thickness of the paper leaf 10 fed by the separating/supplying belt 67 to pass between the conveying belt means 95*a* and 95*b*. The thickness sensor 79 is of a reflection type, and is made to send, to the paper-leaves thickness detecting means 113, a signal corresponding to a rising quantity of the belt of conveying belt means 95*b* when the paper leaf 10 passes between the conveying belt means 95*a* and 95*b*. The paper-leaves thickness detecting means 113 detects the thickness of the paper leave 10 on the basis of the output information from the thickness sensor 79 and sends the thickness information to the system control section 100. The system control section 100 calculates, on the basis of the information from the paper-leaves thickness detecting means 113, an optimum speed to be taken in continuously sending the paper leaves 10 to the paper-leaves feeding position 8 by means of the paper-leaves conveying means 12 and the second paper-leaves conveying means 16, and performs feedback control on the basis of the calculation result. In this case, different gaps between the succeeding paper leaf 10 and the belt contact surface 67*a* take place at the paper-leaves feeding position 8 for when high-thickness paper leaves 10 are fed by the separating/supplying belt 67 and for when low-thickness paper leaves 10 are fed thereby. That is, among the paper leaves 10 being transferred, there are high-thickness paper leaves to low-thickness paper leaves. Accordingly, there is a need to execute the conveying speed control of the paper-leaves conveying means 12 for sending the paper leaves by a quantity corresponding to the thickness of the paper leaf 10. If the paper-leaves conveying means 12 sends the paper leaves 10 at a given speed irrespective of the thickness information, it is required to uniformly send the paper leaves 10 at a conveying speed corresponding to the thinnest paper leaves 10. However, in this case, when thick paper leaves are fed, a wasteful time, such as several seconds, is taken thereafter. For this reason, in order to enhance the mechanical handling ability, the thickness information is used for the control of the paper-leaves conveying means 12. Thus, in the construction according to this embodiment, the thickness of the paper leaves 10 immediately after fed is detected to employ that thickness information for controlling the paper-leaves conveying means 12, thus enhancing the mechanical handling ability.

(A-10) Circuit Arrangement

FIG. 28 is a block diagram showing the entire circuit arrangement of the paper-leaves conveying apparatus of the paper-leaves division system. In FIG. 28, the same reference numerals as those in FIGS. 1 to 27 represent the same parts. In FIG. 28, the entire paper-leaves conveying apparatus is under control of the system control section (CPU) 100, and to the system control section 100 there are connected the reading unit 2, the paper-leaves partitioning section 3, the paper-leaves conveying means 4, the depositing section 11 and the paper-leaves separating/supplying apparatus 9. In addition, the motor 42 for driving the endless chain 21 in the depositing unit 11 is also connected through a motor drive control unit 101 to the system control section 100, while the motor 51 for operating the auxiliary conveying belt means 44A and 44B is connected through a motor control unit 103 to the system control section 100, and further, the motor 59 operative to drive the paper-leaves vibrating means 15 is connected through a motor drive control unit 104 to the system control section 100. Still additionally, in the paper-leaves separating/supplying apparatus 9, the over-press sensor 94 is connected through the over-press detecting means 105 to the system control section 100, the sensor 93 for detecting the presence or absence of the paper leaf 10 is connected through the paper-leaves detecting means 106 to the system control section 100, the vacuum pump 78 is connected through a vacuum pump control means 110 to the system control section 100, the air blower 90 is connected through an air blower control means 111 to the system control section 100, the thickness sensor 79 for detecting the thickness of the paper leaves 10 is connected through the paper-leaves thickness detecting means 113 to the system control section 100, and the motor 71 operative to drive the separating/supplying belt 67 of the separating/supplying device 63 is connected through a motor drive control unit 114 to the system control section 100.

(A-11) Essential Part Control Operation

Figure 29A:
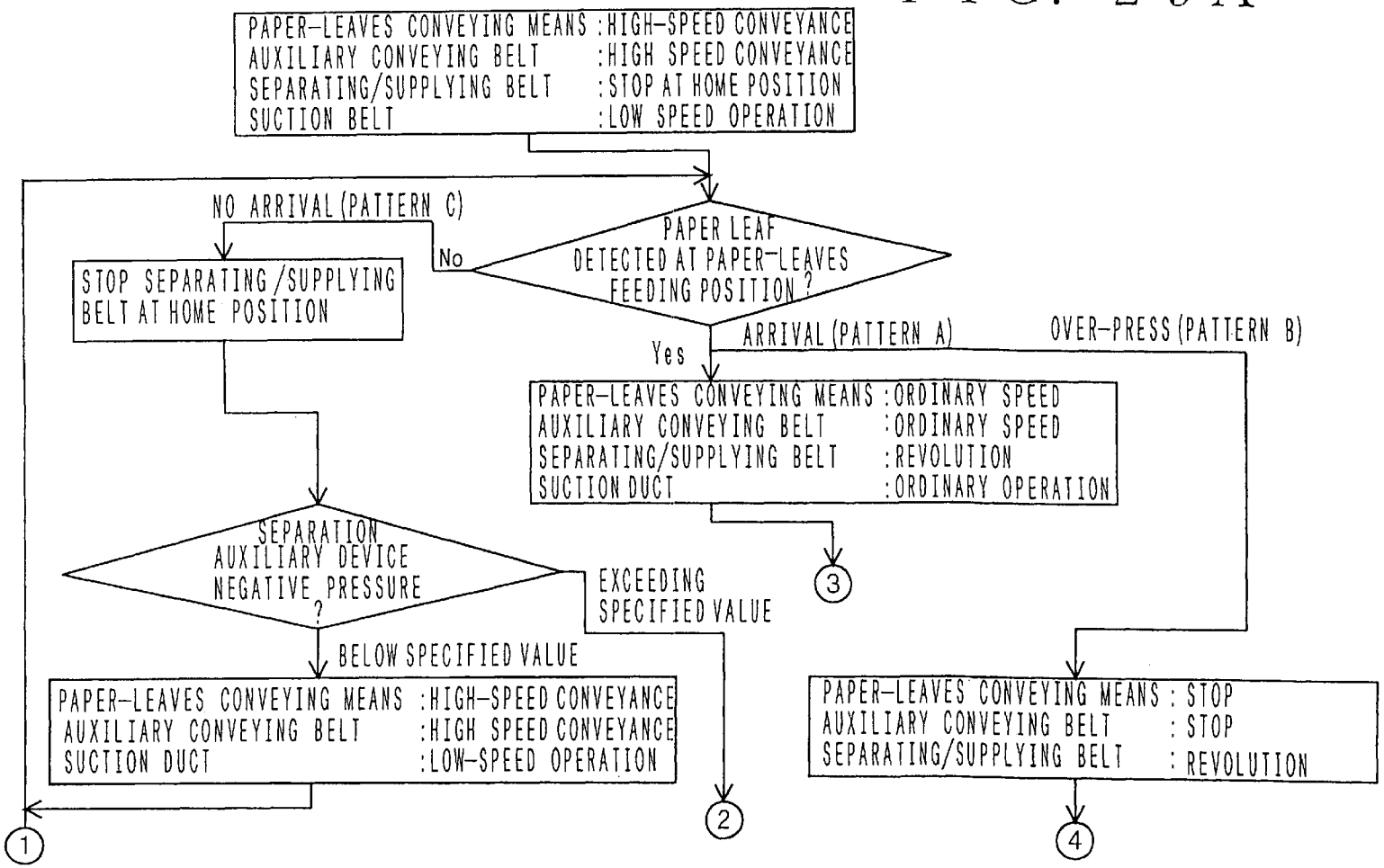
FIGS. 29A and 29B are parts of a flow chart showing an essential operation of the paper-leaves division system according to the embodiment.
Figure 29B:
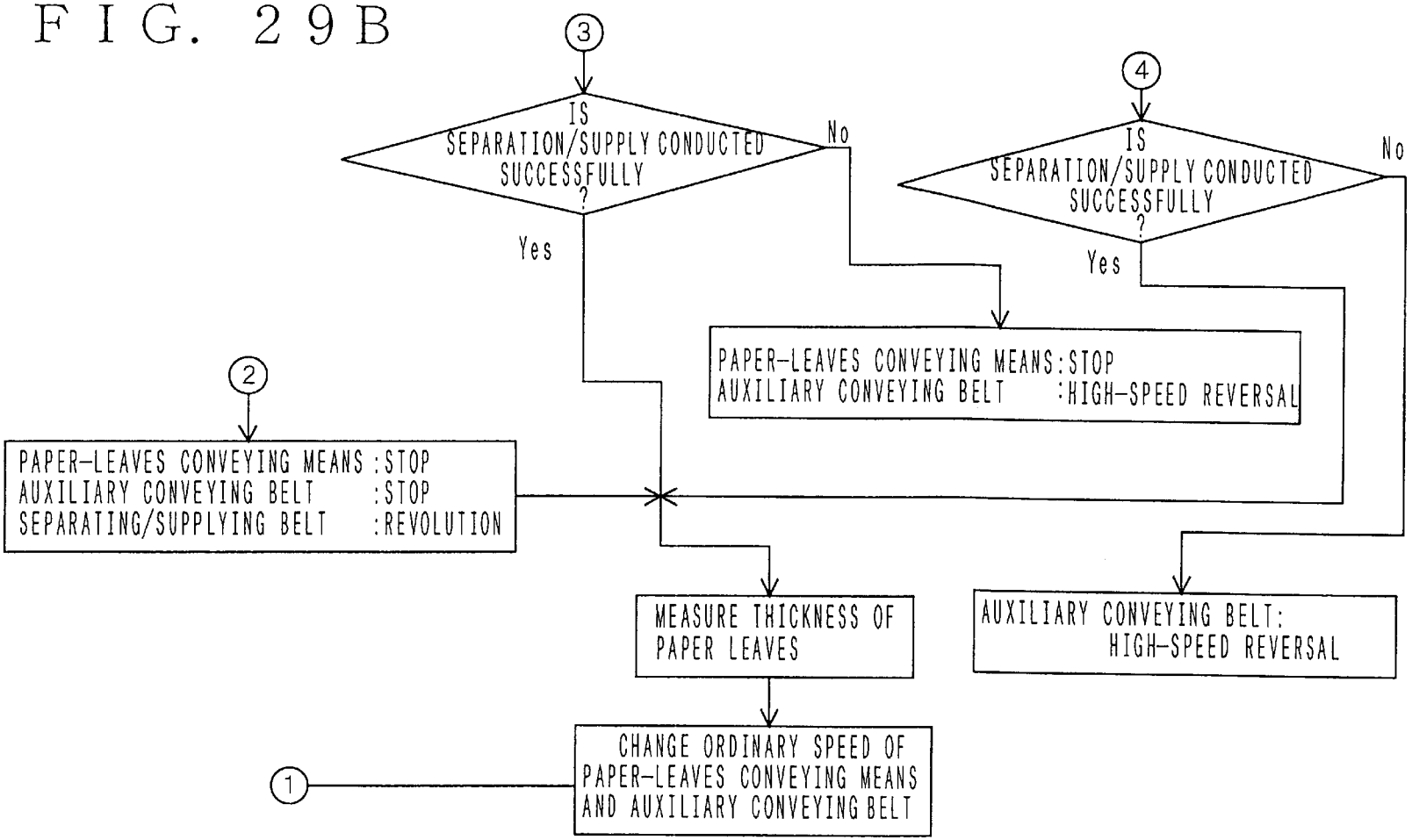

FIGS. 29A and 29B are parts of a flow chart showing an operation of an essential part of the paper-leaves supplying section of the paper-leaves division system. Referring to the flow chart of FIGS. 29A and 29B, a description will be given hereinbelow of a paper-leaves supplying operation according to this embodiment.

Prior to the description of the operation, in the construction according to this embodiment, the suction source for the suction duct 75 (vacuum suction means 68) on the separating/supplying device 63 side and the suction source for the suction duct 84*a* (auxiliary suction means 84) on the separation auxiliary device 64 side are made using one supply source and the principle of the operation in this construction will first be described.

In this construction, the suction duct 75 and the suction duct 84*a* are halfway branched from the same suction source (vacuum pump 78), and when the openings of the suction duct 75 and the suction duct 84*a* appear, both the suction block internal pressures are in the balanced condition and equal to each other. Even though an environment variation occurs, for example, even if any one of them falls into the open or closed condition, although the internal pressures become different from before, they instantaneously return to the balanced condition, that is, become equal to each other. In addition, when the intake opening of any one of them is in an open condition, since a large amount of air is supplied for the vacuum attraction at that intake opening, the vacuum attraction effect is neutralized so that both are balanced at the smaller internal pressure value. This is called leak or atmospheric pressure release.

Accordingly, the operation to be taken from when the paper leaf 10 arrives at the paper-leaves feeding position 8 until the paper leaf 10 is fed through the separating/supplying belt 67 toward the paper-leaves conveying means 4 is as follows (1) to (4). The separating/supplying belt 67 of the separating/supplying device 63 is placed at a position (which will be referred to hereinafter as a "home position") where the suction window 74 of the paper-leaves suction-holding member 67*b* separates from the front surface of the suction duct 75 and a portion of the separating/supplying belt 67 other than the suction window 75 closes the suction opening of the suction duct 75, until the paper leaf 10 is detected by the paper-leaves detecting means 92 or the negative-pressure detecting means 109 at the paper-leaves feeding position 8.

(1) When the paper leaf 10 does not reach the paper-leaves feeding position 8 and the suction opening of the suction duct 75 is covered with the separating/supplying belt 67, that is, the separating/supplying belt 67 is in the stand-by condition, since the suction duct 84*a* is open to the atmosphere, both the internal pressures are balanced at the smaller value. Therefore, an excessive load does not act on the vacuum pump 78 serving as the suction source.

(2) When the paper leaf 10 is conveyed to the paper-leaves feeding position 8 to come into contact with the auxiliary contact surface 80, since the suction duct 75 and the suction duct 84*a* are in a hermetically sealed condition, both the internal pressures are balanced at the higher value. Following this, when the separating/supplying belt 67 is put in rotary motion so that the suction window 74 of the paper-leaves suction holding member 67 confronts the paper leaf 10 in front of the suction duct 75, the paper leaf 10 is attracted by the suction window 74 to keep the covered condition of the front surface of the suction duct 75. In this case, since the intake opening area of the suction duct 75 of the vacuum suction means 68 is set to be larger than the intake opening area of the suction duct 84*a* of the auxiliary suction means 84, on the revolution of the separating/supplying belt 67, the preceding paper leaf 10 is fed in a state adhered to the suction window 74 owing to a large attracting force generated by the vacuum suction means 68 (suction duct 75). ((attracting force=(suction opening internal pressure)×(suction opening area))

(3) Since the preceding paper leaf 10 is fed in a state suction-adhered onto the separating/supplying belt 67 by the vacuum suction means 68 (suction duct 75), when the separation of a bundle of paper leaves 10 starts, the suction duct 84*a* of the auxiliary suction means 84 is released from the hermetically sealed condition, slight atmospheric pressure release occurs to reduce the internal pressure. Therefore, it is possible to smoothly conduct the operation that the preceding paper leaf 10 is released from the attraction by the auxiliary suction means 84.

(4) The succeeding paper leaf 10 transferred by the paper-leaves conveying means 12, the conveying belt means 43A and 43B of the paper-leaves conveying means 16 and the auxiliary conveying belt means 44A and 44B immediately after that is brought into contact with the auxiliary contact surface 80. Therefore, the suction duct 75 and the suction duct 84*a* fall into the hermetically sealed condition and, hence, both the internal pressures thereof are balanced at the higher value. Accordingly, the succeeding paper leaf 10 suction-attracted through the suction duct 84*a* is held so as not to be not fed at an unstable timing, and the preceding paper leaf 10 is separated and fed with a large force. In other words, the paper-leaves feeding is achieved by substantially valve opening/closure control using the paper leaf 10 itself.

Furthermore, when a plurality of paper leaves 10 are deposited together in a bundle in the depositing section 11 of the paper-leaves supplying section 1, they are subdivided and set between the partitioning arm device 19 and the partitioning arm device 19 in a stand-up condition and supported from both the sides by the arms (18*a*, 18*b* and 18*a*, 18*b*) of the partitioning arm devices 19. When no paper leaf 10 is detected by the paper-leaves detecting means 92 or the negative-pressure detecting means 109 at the paper-leaves feeding position 8, each of the paper-leaves conveying means 12, the conveying belt means 43*a*, 43B of the second paper-leaves conveying means 16 and the auxiliary conveying belt means 44A, 44B is operated at a higher speed than that in the ordinary state, and the paper leaves 10 deposited in the depositing section 11 undergo the vibrations by the paper-leaves vibrating means 15 to be put in order, and are conveyed to the paper-leaves feeding position 8 at the higher speed in the stand-up condition by means of the paper-leaves conveying means 12, the conveying belt means 43A, 43B of the second paper-leaves conveying means 16 and the auxiliary conveying belt means 44A, 44B. When the paper leaf 10 is conveyed to the paper-leaves feeding position 8 at the higher speed and is detected by the paper-leaves detecting means 92 or the negative-pressure detecting means 109, then the speed of the paper-leaves conveying means 12, the conveying belt means 43*a*, 43B of the second paper-leaves conveying means 16 and the auxiliary conveying belt means 44A, 44B is synchronized with that of the paper-leaves feeding operation in the separating/supplying device 63.

On the other hand, the separating/supplying belt 67 of the separating/supplying device 63, as mentioned above, stays at the home position until the paper leaf 10 arrives at the paper-leaves feeding position 8 and is detected by the paper-leaves detecting means 92 (paper-leaves arrival detecting means 106) or the negative-pressure detecting means 109, and a suction hole 75 is covered with the separating/supplying belt 67 of the separating/supplying device 63 in order to prevent the paper leaves from jumping to the suction hole 75 and being separated and fed. At this time, the output of the vacuum pump 78 is placed in a saving condition (low-speed operation). Thus, when the vacuum suction is not required actually, the output of the vacuum pump 78 is placed in the saving condition, thereby reducing unnecessary noise and the power consumption. At the same time, this can lengthen the life of the vacuum pump 78. Accordingly, while the suction duct 75 is not required to conduct the suction operation, without lowering the suction force on the suction duct 84 side, it is possible to reduce the noise and avoid the waste on power consumption, and further to lengthen the life of the vacuum pump 78. In addition, when the paper leaf 10 arrives at the paper-leaves feeding position 8 and is detected by the paper-leaves detecting means 92 (paper-leaves arrival detecting means 106), the vacuum pump 78 is released from the output saving condition to enter in the ordinary operation. In addition, the separating/supplying belt 67 is placed in rotary motion to separate and feed the paper leaves 10. On the other hand, when it is detected by the negative-pressure detecting means 109, since both the intake openings of the suction ducts 75 and 84*a* are already in the covered condition so that the internal pressures become high, the separating/supplying belt 67 is put in rotary motion to feed the paper leaves 10 in a state where the vacuum pump 78 is kept in the saving condition (low-speed operation). Moreover, even when both the intake opening of the suction duct 75 and the intake opening of the suction duct 85 are put in the covered condition, the internal pressures increase rapidly and the negative pressure detecting means 109 detects the negative pressure so that a decision is made that the paper leaf 10 has arrived at the paper-leaves feeding position 8, with the result that the vacuum pump 78 is released from the controlled output, and the separating/supplying belt 67 is put in the rotary motion to separate and feed the paper leaves 10.

The control to be implemented thereafter involves handling (pattern A) to be taken for when the paper leaf 10 conveyed to the feeding position is detected by the paper-leaves detecting means 106, handling (pattern B) to be conducted for when, although the paper leaf 10 is detected by the paper-leaves detecting means 106, an over-press condition is detected by the paper-leaves over-press detecting means, and handling (pattern C) to be conducted for when, although the paper leaf 10 is not detected by the paper-leaves detecting means 106, the negative-pressure sensor 87 indicates a negative pressure value exceeding a predetermined value and the negative-pressure detecting means 109 detects that negative pressure condition. The handling in these patterns A, B and C will be described hereinbelow.

(Pattern A)

When the paper leaf 10 arrives at the paper-leaves feeding position 8 and strikes on the contact 92, the contact 92 is retracted so that the shade 92*a* enters the sensor 93. At this time, the output information from the sensor 93 indicates the presence of the paper leaf 10 conveyed to the paper-leaves feeding position 8. When the paper-leaves detecting means 106 detects the paper leaf 10, the speed of conveyance by the paper-leaves conveying means 12, the conveying belt means 43A, 43B of the second paper-leaves conveying means 16 and the auxiliary conveying belt means 44A, 44B is returned to the ordinary speed synchronized with the feeding operation of the paper leaves 10 by the separating/supplying belt 67. Simultaneously, the vacuum pump 78 is released from the saving (limited) operation. In addition, the separating/supplying belt 67 is placed in rotary motion, and the paper leaves 10 are suction-held halfway by the paper-leaves suction-holding members 67*b* and are fed between the conveying belt means 95*a* and 95*b* of the paper-leaves conveying means 4. While passing between the conveying belt means 95*a* and 95*b* of the paper-leaves conveying means 4, the paper leaves 10 undergo the thickness detection on the basis of the output information from the paper-leaves thickness sensor 79, and the system control section 100 corrects, on the basis of the thickness, the conveying speed of the paper-leaves conveying means 12 and the conveying belt means 43A, 43B of the second paper-leaves conveying means 16, that is, the above-mentioned feedback control is implemented, thereby establishing the synchronization between the feeding by the separating/supplying belt 67 and the feeding by the paper-leaves conveying means 12 and the conveying belt means 43A, 43B of the second paper-leaves conveying means 16. In this case, the feeding speeds of the paper-leaves conveying means 12 and the conveying belt means 43A and 43B of the second paper-leaves conveying means 16 are equal to each other, and are set to the feeding capability of the separating/supplying belt 67. Incidentally, if the separating/supplying belt 67 fails to feed the paper leaves 10, the paper-leaves conveying means 12 and the conveying belt means 43A, 43B of the second paper-leaves conveying means 16 are stopped, and the auxiliary conveying belt means 44A and 44B are reversed at a higher speed for a given period of time to once separate the paper leaf 10 from the belt contact surface 67*a*, and then the feeding operation is again conducted by the separating/supplying belt 67. If this feeding operation fails several times, an alarm is issued to an operator for necessary handling.

(Pattern B)

When the contact 92 is pressed excessively (more than necessary) by the paper leaf 10 at the paper-leaves feeding position 8 and the shade 92*b* enters the interior of the sensor 94, the over-press detecting means 105 detects, on the basis of the output information from the sensor 94, that the paper leaf 10 is pressed excessively at the paper-leaves feeding position 8. Upon this detection, the system control section 100 conducts the feeding operation of the paper leaves 10 through the use of the separating/supplying belt 67 in a state where stopped are the feeding by the paper-leaves conveying means 12 and the conveying belt means 43A, 43B of the second paper-leaves conveying means 16 and the feeding by the auxiliary conveying belt means 44A and 44B. When the feeding of the paper leaves 10 by the separating/supplying belt 67 is accomplished successfully, as with the case of the pattern A, the paper leaves 10 are transferred between the conveying belt means 95*a* and 95*b* to be conveyed to the downstream side while the thickness thereof is detected by the paper-leaves thickness sensor 79 on the way. On the other hand, if the feeding operation of the paper leaves 10 by the separating/supplying belt 67 fails, the higher-speed reverse revolution of the auxiliary conveying belt means 44A and 44B is made for a given period of time in a state where stopped are the paper-leaves conveying means 12 and the conveying belt means 43A, 43B of the second paper-leaves conveying means 16, in order to once separate the paper leaf 10 from the belt contact surface 67*a*, and then the feeding operation by the separating/supplying belt 67 is again conducted. If this feeding operation fails several times, an alarm is issued to the operator for necessary handling.

(Pattern C)

In a case in which, although the paper leaf 10 arrives at the paper-leaves feeding position 8, the paper leaf 10 somewhat shifts so that the paper-leaves detecting means 106 cannot detect the paper leaf 10 because it does not strike against the contact 92 but the paper leaf 10 comes into contact with the auxiliary contact surface 80, the negative pressure in the interior of the suction duct 84*a* of the separation auxiliary device 64 exceeds a specified value. For this reason, when the negative pressure detected by the negative pressure sensor 87 is below the specified value, a decision is made that the paper leaf 10 does not arrive at the paper-leaves feeding position 8 yet, and the separating/supplying belt 67 and the vacuum pump 78 are placed in the stand-by condition. On the other hand, when the negative pressure exceeds the specified value, a decision is made that the paper leaf 10 exists thereat. Upon this decision, the feeding is conducted by the separating/supplying belt 67 in a state where stopped are the feeding by the paper-leaves conveying means 12 and the conveying belt means 43A, 43B of the second paper-leaves conveying means 16 and the feeding by the auxiliary conveying belt means 44A and 44B. Following this, as in the case of the pattern A, the paper leaf 10 is sent between the conveying belt means 95*a* and 95*b* and further conveyed to the downstream side while the thickness thereof is measured by the paper-leaves thickness sensor 79 on the way. The other operation is the same as that in the pattern A.

As described above, in accordance with the present invention, a belt surface of a separating/supplying belt is provided in a state perpendicular to a traveling plane of a plurality of paper leaves set together and conveyed in a stand-up condition or in a state inclined toward the paper leaves conveyed, and the paper leaves, conveyed as far as a position at which they come into contact with the belt surface, are taken up by one by vacuum suction on the belt surface side so that the paper leaf adheres onto the belt surface, and the one paper leaf taken up is fed toward the downstream side in accordance with the rotary motion of the separating/supplying belt. Thus, the preceding paper leaf coming previously into contact with the belt surface is attracted and held on the separating/supplying belt in a state parallel with or inclined toward the succeeding paper leaf and then fed in accordance with the rotary motion of the separating/supplying belt. Accordingly, the weight of the succeeding paper leaf hardly fall on the preceding paper leaf when the preceding paper leaf is fed to the downstream side; therefore, it is possible to provide a paper-leaves separating/supplying apparatus which is capable of minimizing the contact pressure between the preceding paper leaf and the succeeding paper leaf to achieve smooth feeding thereof. In addition, it is possible to prevent the succeeding paper leaf from being dragged by the preceding paper leaf to be disarranged in posture, which assures that the paper leaves are conveyed with accuracy without the occurrence of troubles.

In addition, as described above, in a paper-leaves separating/supplying apparatus according to the present invention, under a separating/supplying means for holding a plurality of paper leaves, set together and conveyed up to a position of a belt surface of a separating/supplying belt in a stand-up condition, one by one on the belt surface of the separating/supplying belt, put in rotary motion, by means of vacuum suction, there are placed an auxiliary contact surface for receiving a lower end portion of each of the paper leaves conveyed thereto and a second vacuum suction means for vacuum-sucking the lower end portion of the paper leaf to the auxiliary contact surface. Accordingly, even though a mechanical paper-leaves arrival sensor fails to detect that the paper leaf has arrived at the position of the belt surface and outputs no signal representative of the arrival of the paper leaves, the negative pressure in the second vacuum suction means is measured and, when the measured negative pressure exceeds a specified value, a decision is made to the arrival of the paper leaf on the basis of the measured negative pressure to implement the paper-leaves feeding operation by the separating/supplying means. Owing this construction and control, it is possible to provide a paper-leaves separating/supplying apparatus capable of detecting the paper leaves conveyed to the feeding position with higher accuracy than that of the conventional apparatus, and of continuously feeding the paper leaves properly and promptly.

Still additionally, according to the present invention, as described above, since the preceding paper leaf arriving previously at the paper-leaves feeding position is warped into an arch-like configuration so that both end portions thereof protrude toward the succeeding paper leaf, when the succeeding paper leaf is conveyed in a state brought into contact with the preceding paper leaf, this warping flips or pushes the succeeding paper leaf to set up the separation between the preceding paper leaf and the succeeding paper leaf, thus achieving regular conveyance of the paper leaves without the occurrence of overlap transportation.

Moreover, when air is supplied to the arched paper leaf from the under at the paper-leaves feeding position to set up the separation with respect to the succeeding paper leaf, the air supply more positively makes the separation between the preceding paper leaf and the succeeding paper leaf in cooperation with the protrusion of both the end portions of the preceding paper leaf.

It should be understood that the present invention is not limited to the above-described embodiment, and that it is intended to cover all changes and modifications of the embodiments of the invention herein which do not constitute departures from the spirit and scope of the invention.

What is claimed is:

1. A paper-leaves separating/supplying method comprising the steps of:

placing a plurality of paper leaves on a paper-leaves conveying means composed of main conveying means and auxiliary conveying means so that planar surfaces of said plurality of paper leaves are substantially perpendicular to a paper-leaves supporting/conveying plane of said main conveying means of said paper-leaves conveying means to take a stand-up condition and said auxiliary conveying means receives said plurality of paper leaves from said main conveying means to convey said plurality of paper leaves to a belt surface of a separating/supplying belt placed in a state substantially perpendicular to a conveying direction of said plurality of paper leaves set together in a state inclined toward said plurality of paper leaves conveyed;

taking up said plurality of paper leaves, conveyed up to a position at which said plurality of paper leaves come into contact with the belt surface, one by one by means of vacuum suction located on the belt surface side so that each paper leaf is attached onto the belt surface; and feeding said each paper leaf taken up toward the downstream side in accordance with rotary motion of said separating/supplying belt.

2. A paper-leaves separating/supplying apparatus comprising:

a rotary separating/supplying belt;

paper-leaves conveying means for conveying paper leaves toward said separating/supplying belt, said paper-leaves conveying means being composed of main conveying means for receiving said paper leaves set together and auxiliary conveying means for receiving said paper leaves from said main conveying means to convey said paper leaves to said separating/supplying belt;

vacuum suction means for taking up said plurality of paper leaves, set together and conveyed by said paper-leaves conveying means, through the use of vacuum suction so that said paper leaves are attached onto a belt surface of said separating/supplying belt; and separating/supplying means for feeding said paper leaves, attached onto said belt surface by the vacuum suction, one by one to the downstream side in accordance with rotary motion of said separating/supplying belt, wherein planar surfaces of said plurality of paper leaves conveyed are substantially perpendicular to a paper-leaves supporting/conveying plane of said paper-leaves conveying means, to take a stand-up condition and said belt surface of said separating/supplying belt is placed in a state substantially perpendicular to a conveying direction of said paper leaves.

3. The paper-leaves separating/supplying apparatus according to claim 2, wherein when one of said paper leaves approaches said separating/supplying belt, said main conveying means are stopped while said auxiliary conveying means is once driven in a direction opposite to the paper-leaves conveying direction to return said paper leaf by a predetermined quantity for preventing said paper leaf from being excessively pressed against said separating/supplying belt.

4. The paper-leaves separating/supplying apparatus according to claim 3, further comprising thickness detecting means for detecting a thickness of said plurality of paper leaves so that a speed at which said paper-leaves conveying section conveys said plurality of paper leaves is controlled on the basis of the thickness detected by said thickness detecting means.

5. The paper-leaves separating/supplying apparatus according to claim 2, further comprising a paper leaves conveying section for conveying said plurality of paper leaves toward said separating/supplying belt in the stand-up condition, said paper-leaves conveying section including a back wall for supporting back surface portions of the plurality of paper leaves put therein, and said back wall being composed of a plurality of plates having different widths and disposed stepwise to successively retreat backwardly by a predetermined dimension.

6. The paper-leaves separating/supplying apparatus according to claim 2, further comprising separation auxiliary means placed under said separating/supplying belt to make a predetermined angle with respect to said separating/supplying belt, said separation auxiliary means being made to attract each paper leaf conveyed to said separating/supplying belt by means of vacuum suction, causing said each paper leaf to bend and have an arcuate cross section so that said each paper leaf is attached thereon to form a gap with respect to an immediately succeeding paper leaf.

7. A paper-leaves separating/supplying apparatus comprising:

a rotary separating/supplying belt;

paper-leaves conveying means for conveying paper leaves toward said separating/supplying belt, said paper-leaves conveying means being composed of main conveying means for receiving said paper leaves set together and auxiliary conveying means for receiving said paper leaves from said main conveying means to convey said paper leaves to said separating/supplying belt:

vacuum suction means for taking up said plurality of paper leaves, set together and conveyed by paper-leaves conveying means, through the use of vacuum suction so that said paper leaves are attached onto a belt surface of said separating/supplying belt; and separating/supplying means for feeding said paper leaves, attached onto said belt surface by the vacuum suction, one by one to the downstream side in accordance with rotary motion of said separating/supplying belt, wherein planar surfaces of said plurality of paper leaves conveyed by paper-leaves conveying means are substantially perpendicular to a paper-leaves supporting/conveying plane of said paper-leaves conveying means, to take a stand-up condition and said belt surface of said separating/supplying belt is placed in a state inclined by a predetermined angle toward said paper leaves conveyed.

8. The paper-leaves separating/supplying apparatus according to claim 7, further comprising separation auxiliary means placed under said separating/supplying belt to make a predetermined angle with respect to said separating/supplying belt, said separation auxiliary means being made to attract each paper leaf conveyed to said separating/supplying belt by means of vacuum suction, causing said each paper leaf to bend and have an arcuate cross section so that said each paper leaf is attached thereon to form a gap with respect to an immediately succeeding paper leaf.

9. The paper-leaves separating/supplying apparatus according to claim 2, wherein when one of said paper leaves approaches said separating/supplying belt, said main conveying means are stopped while said auxiliary conveying means is once driven in a direction opposite to the paper-leaves conveying direction to return said paper leaf by a predetermined quantity for preventing said paper leaf from being excessively pressed against said separating/supplying belt.

10. The paper-leaves separating/supplying apparatus according to claim 9, further comprising thickness detecting means for detecting a thickness of said plurality of paper leaves so that a speed at which said paper-leaves conveying section conveys said paper leaves is controlled on the basis of the thickness detected by said thickness detecting means.

11. The paper-leaves separating/supplying apparatus according to claim 7, further comprising a paper-leaves conveying section for conveying said plurality of paper leaves toward said separating/supplying belt in the stand-up condition, said paper-leaves conveying section including a back wall for supporting back surface portions of the plurality of paper leaves put therein, and said back wall being composed of a plurality of plates having different widths and disposed stepwise to successively retreat backwardly by a predetermined dimension.

12. A paper-leaves separating/supplying method comprising the steps of:

vacuum-sucking a plurality of paper leaves, set together and conveyed in a stand-up condition so that planar surfaces of said plurality of paper leaves conveyed are substantially perpendicular to a paper-leaves supporting/conveying plane of paper-leaves conveying means, one by one toward a belt surface of a separating/supplying belt of separating/supplying means;

bringing a lower end portion of said paper leaf, conveyed to a position of said belt surface, into contact with an auxiliary contact surface placed under said separating/supplying means for feeding said paper leaves to the downstream side in accordance with rotary motion of said separating/supplying belt;

attracting the lower end portion of said paper leaf onto said auxiliary contact surface through the use of auxiliary vacuum suction means; and measuring a negative pressure of said auxiliary vacuum suction means for detecting that said paper leaf arrives at the position of said belt surface.

13. The paper-leaves separating/supplying method according to claim 12, wherein, when the measured negative pressure in said auxiliary vacuum section exceeds a predetermined value, said plurality of paper leaves are fed by said separating/supplying means without waiting for a signal from a paper-leaves arrival detecting means placed in the vicinity of a position of said separating/supplying belt for directly detecting that said each paper leaf arrives at the position of said belt surface.

14. A paper-leaves separating/supplying apparatus comprising:

separating/supplying means including a rotary separating/supplying belt and first vacuum suction means for vacuum-sucking each of a plurality of paper leaves, set together and conveyed by paper-leaves conveying means in a stand-up condition so that planar surfaces of said plurality of paper leaves conveyed are substantially perpendicular to a paper-leaves supporting/conveying plane of said paper-leaves conveying means, through a belt surface of said separating/supplying belt to suction-hold said paper leaf on said belt surface, said separating/supplying means feeding said paper leaves, suction-held on said belt surface, one by one to the downstream side in accordance with rotary motion of said separating/supplying belt;

auxiliary separation means including an auxiliary contact surface placed under said separating/supplying means for receiving a lower end portion of said paper leaf conveyed to said belt surface and second vacuum suction means for generating a vacuum suction force to attract the lower end portion of said paper leaf onto said auxiliary contact surface;

a paper-leave arrival detecting means for detecting the arrival of said paper leaf when said paper leaf is conveyed to said belt surface;

negative pressure measuring means for measuring a negative pressure in said second vacuum suction means; and control means for implementing feeding operations of said paper leaves through the use of said separating/supplying means.

15. The paper-leaves separating/supplying apparatus according to claim 14, wherein, when the measured negative pressure in said auxiliary vacuum section exceeds a predetermined value, said control means controls said separating/supplying means to feed said each of a plurality of paper leaves irrespective of the presence or absence of an output of a detection signal from said paper-leaves arrival detecting means.

16. A paper-leaves separating/supplying method comprising the steps:

vacuum-sucking a plurality of paper leaves, set together and conveyed up to a paper-leaves feeding position by paper-leaves conveying means in a stand-up condition so that planar surfaces of said plurality of paper leaves conveyed are substantially perpendicular to a paper-leaves supporting/conveying plane of said paper-leaves conveying means, one by one toward a belt surface of a separating/supplying belt of separating/supplying means;

bring a lower end portion of said paper leaf, transferred to said belt surface, into contact with an auxiliary contact surface placed under said separating/supplying means for feeding the paper leaves to the downstream side in accordance with rotary motion of said separating/supplying belt;

attracting the lower end portion of said paper leaf onto said auxiliary contact surface through the use of auxiliary vacuum suction means; and when said paper leaf is suction-attracted onto said auxiliary contact surface, making a central portion of said paper leaf protrude to said auxiliary contact surface side and making both sides of said paper leaf warp so that its horizontal cross section forms a generally arch-like configuration.

17. The paper-leaves separating/supplying method according to claim 16, wherein air is supplied to each warped paper leaf from below to separate said each warped paper leaf from an immediately preceding paper leaf.

18. A paper-leaves separating/supplying apparatus comprising:

separating/supplying means including a rotary separating/supplying belt and first vacuum suction means for vacuum-sucking each of a plurality of paper leaves, set together and conveyed by paper-leaves conveying means in a stand-up condition so that planar surfaces of said plurality of paper leaves conveyed are substantially perpendicular to a paper-leaves supporting/conveying plane of said paper-leaves conveying means, to a paper-leaves feeding position, through a belt surface of said separating/supplying belt to suction-hold said paper leaf on said belt surface, with said separating/supplying means feeding said paper leaves suction-held on said belt surface one by one to the downstream side in accordance with rotary motion of said separating/supplying belt; and auxiliary separation means including an auxiliary contact surface placed under said separating/supplying means to confront a lower end portion of said paper leaf conveyed to said paper-leaves feeding position and second vacuum suction means for generating a vacuum suction force at a position behind said auxiliary contact surface to attract the lower end portion of said paper leaf onto said auxiliary contact surface, said auxiliary contact surface having an irregular member whereby, when said paper leaf is attracted onto said auxiliary contact surface, a central portion of said paper leaf protrudes toward the auxiliary contact surface side and both end portions thereof protrude toward the succeeding paper leaf coming afterward so that a horizontal cross section of said paper leaf is warped into a generally arch-like configuration.

19. The paper-leaves separating/supplying apparatus according to claim 18, wherein said auxiliary contact surface is disposed to make a predetermined angle between said auxiliary contact surface and said belt surface of said separating/supplying belt so that said each paper leaf attracted onto said auxiliary contact surface is bent toward the immediately succeeding paper leaf.

20. The paper-leaves separating/supplying apparatus according to claim 18, wherein said irregular member of said auxiliary contact surface is formed so that a lower end portion thereof is configured to be flat to enlarge a gap between the lower end portion of said each paper leaf attracted onto said auxiliary contact surface and the immediately succeeding paper leaf.

21. A paper-leaves separating/supplying apparatus comprising:

separating/supplying means including a rotary separating/supplying belt and first vacuum suction means for vacuum-sucking each of a plurality of paper leaves, set together and conveyed by paper-leaves conveying means in a stand-up condition so that planar surfaces of said plurality of paper leaves conveyed are substantially perpendicular to a paper-leaves supporting/conveying plane of said paper-leaves conveying means, to a paper-leaves feeding position, through a belt surface of said separating/supplying belt to suction-hold said paper leaf on said belt surface, with said separating/supplying means feeding said paper leaves suction-held on said belt surface one by one to the downstream side in accordance with rotary motion of said separating/supplying belt;

auxiliary separation means including an auxiliary contact surface placed under said separating/supplying means to confront a lower end portion of said paper leaf conveyed to said paper-leaves feeding position and second vacuum suction means for generating a vacuum suction force at a position behind said auxiliary contact surface to attract the lower end portion of said paper leaf onto said auxiliary contact surface and an irregular member whereby, when said paper leaf is attracted onto said auxiliary contact surface, a central portion of said paper leaf protrudes toward the auxiliary contact surface side and both end portions thereof protrude toward the succeeding paper leaf coming afterward so that a horizontal cross section thereof is warped into a generally arch-like configuration; and air blowing means for supplying air between the preceding paper leaf, attracted onto said auxiliary contact surface, and the succeeding paper leaf from under said paper leaves to make separation between the preceding paper leaf and the succeeding paper leaf.

22. The paper-leaves separating/supplying apparatus according to claim 21, wherein said irregular member is formed so that a lowermost portion thereof that corresponds to the lower end portion of said each paper leaf that is brought into contact with said auxiliary contact surface is configured to be flat to enlarge a gap between the lowermost portion of said each paper leaf attracted onto said auxiliary contact surface and the immediately succeeding paper leaf.

* * * * *